US011383354B1

(12) United States Patent
Taylor et al.

(10) Patent No.: US 11,383,354 B1
(45) Date of Patent: Jul. 12, 2022

(54) VISE

(71) Applicant: Jergens, Inc., Cleveland, OH (US)

(72) Inventors: Darel R. Taylor, Willoughby, OH (US); Glenn A. Baker, Seven Hills, OH (US); Michael T. Antos, Painseville Township, OH (US); Joseph R. Cousins, Kittanning, PA (US)

(73) Assignee: Jergens, Inc., Cleveland, OH (US)

( * ) Notice: Subject to any disclaimer, the term of this patent is extended or adjusted under 35 U.S.C. 154(b) by 246 days.

(21) Appl. No.: 16/561,876

(22) Filed: Sep. 5, 2019

Related U.S. Application Data

(60) Provisional application No. 62/727,852, filed on Sep. 6, 2018.

(51) Int. Cl.
*B25B 1/10* (2006.01)
*B25B 1/24* (2006.01)

(52) U.S. Cl.
CPC ..... *B25B 1/103* (2013.01); *B25B 1/2473* (2013.01); *B25B 1/2478* (2013.01); *B25B 1/2484* (2013.01); *B25B 1/2405* (2013.01)

(58) Field of Classification Search
CPC ..... B25B 1/2405; B25B 1/103; B25B 1/2473; B25B 1/24; B25B 1/00; B25B 1/12; B25B 1/2478; B25B 1/2484; B25B 1/2489
USPC ..... 269/136, 43, 154
See application file for complete search history.

(56) References Cited

U.S. PATENT DOCUMENTS 2,564,138 A * 8/1951 Walker ..... B25B 1/24 269/95
2,880,638 A * 4/1959 Muggli ..... B25B 1/2473 269/139
3,397,880 A * 8/1968 Kuban ..... B25B 1/10 269/240
4,098,500 A * 7/1978 Lenz ..... B25B 1/103 269/136
4,934,674 A * 6/1990 Bernstein ..... B25B 1/103 269/136
5,043,144 A 8/1991 Gordon et al.
5,098,073 A 3/1992 Lenz
5,242,159 A * 9/1993 Bernstein ..... B25B 1/18 269/136

(Continued)

FOREIGN PATENT DOCUMENTS

DE 20211275 U1 9/2002
DE 102015014664 B3 4/2017

OTHER PUBLICATIONS

Abstract via Google Translate:DE 20211275 (U1), Published Sep. 26, 2002, 1 pg.

(Continued)

*Primary Examiner* — Mahdi H Nejad

(74) *Attorney, Agent, or Firm* — Rankin, Hill & Clark LLP

(57) ABSTRACT

A vise for holding a workpiece that reduces jaw lift having a vise base with a longitudinally extending guide channel that includes vise base flanges with base flange guide surfaces, the vise having vise trucks that move longitudinally within the guide channel, the vise having jaws that are selectively securable relative to the trucks wherein the jaws and the trucks include lift surfaces that move the trucks toward the jaws transversely to the longitudinal direction as the jaws engage the workpiece to lock the jaws and the trucks relative to the guide channel when the workpiece is clamped in the vise.

23 Claims, 13 Drawing Sheets

(56) References Cited

U.S. PATENT DOCUMENTS

| | | | | |
|---|---|---|---|---|
| 5,649,694 | A | 7/1997 | Buck | |
| 5,893,551 | A | 4/1999 | Cousins et al. | |
| 6,079,704 | A * | 6/2000 | Buck | B25B 1/24 269/279 |
| 6,139,001 | A | 10/2000 | Buck | |
| 6,409,161 | B1 * | 6/2002 | Wolff | B25B 1/18 269/134 |
| 7,163,201 | B2 * | 1/2007 | Bernstein | B25B 1/103 269/32 |
| 8,020,877 | B2 | 9/2011 | Lang | |
| 8,256,753 | B2 | 9/2012 | Teo | |
| 8,408,527 | B2 | 4/2013 | Klingenberg et al. | |
| 9,004,472 | B2 | 4/2015 | Schmidt | |
| 9,095,958 | B2 | 8/2015 | Schmidt | |
| 9,296,089 | B2 | 3/2016 | Schweigert et al. | |
| 9,364,937 | B2 | 6/2016 | Taylor et al. | |

OTHER PUBLICATIONS

Espacenet Bibliographic data:DE 102015014664 (B3), Published Apr. 27, 2017, 2 pgs.

Jergens, Inc., Production Vises Catalog, pp. 103-148, Cleveland, Ohio.

* cited by examiner

VISE

This application claims priority to provisional patent application Ser. No. 62/727,852 filed on Sep. 6, 2018, which is incorporated by reference herein.

The invention of this application relates to vises and, more particularly, to multiple jaw vises and, even more particularly, to self-centering vises, even more particularly to 5-axis machining and multi axis machining vises. It has also been found that the invention of this application can be used for multi-station vises. Yet even further, the invention of this application is well adapted for use with other tooling equipment, such as Applicant's FIXTURE PRO® line of products.

INCORPORATION BY REFERENCE

The invention of this application relates to vises and, more particularly, to multiple jaw vises that are self-centering. Multiple jaw vises and self-centering vises are known in the art. In particular, U.S. Pat. No. 5,649,694 to Buck discloses a multiple jaw vise and is incorporated by reference herein for showing the same. Similarly, U.S. Pat. No. 6,079,704 to Buck discloses a multiple jaw vise and is incorporated by reference herein for showing the same. U.S. Pat. No. 6,139,001 to Buck discloses a multiple jaw vise and is incorporated by reference herein for showing the same. U.S. Pat. No. 5,893,551 to Cousins et al. discloses a multiple jaw vise with machinable jaws and is incorporated by reference herein for showing the same. U.S. Pat. No. 5,098,073 to Lenz discloses a multiple jaw vise with a double threaded screw and is incorporated by reference herein for showing the same. U.S. Pat. No. 8,408,527 to Klingenberg et al. discloses a multi-jaw vise and is incorporated by reference herein for showing the same. U.S. Pat. No. 9,095,958 to Schmidt discloses a self-centering dual direction clamping vise and is incorporated by reference herein for showing the same. U.S. Pat. No. 9,296,089 to Schweigert et al. discloses a centric clamping vise and is incorporated by reference herein for showing the same. U.S. Pat. No. 5,043,144 to Gordon et al. discloses a self-centering vise and is incorporated by reference herein for showing the same. U.S. Pat. No. 9,364,937 to Taylor et al. discloses a centric clamping vise and is incorporated by reference herein for showing the same. U.S. Pat. No. 2,564,138 to Walker discloses a machine vise and is incorporated by reference herein for showing the same. U.S. Pat. No. 9,004,472 to Schmidt discloses a five axis machine vise and is incorporated by reference herein for showing the same. U.S. Pat. No. 8,020,877 to Lang discloses a self-centering chuck and is incorporated by reference herein for showing the same. U.S. Pat. No. 8,256,753 to Teo discloses a vise that prevents jaw lift and is incorporated by reference herein for showing the same. German Publication No. DE 202 11 275 (copy submitted herewith) discloses a self-centering vise and is incorporated by reference herein for showing the same. German Publication No. DE 10 2015 014 664 (copy submitted herewith) discloses a self-centering vise and is incorporated by reference herein for showing the same. Also incorporated by reference herein in its entirety is JERGENS Production Vise Catalog which is submitted herewith and forms part of this specification as does the above incorporation by reference documents.

BACKGROUND OF THE INVENTION

Vises are well known in the art and have evolved over the years. Further, multiple jaw vises and self-centering vises are also known in the art and have been well received. In particular, the vises shown in many of the patents listed above, and incorporated by reference in this application as background material, have been well received in the marketplace. These patents disclose two jaw and self-centering vises that are effective and which have been used in industry for many years. However, many of these vises are costly to manufacture, are costly and difficult to maintain in the field, and can require many adjustments to function properly.

A self-centering vise is a vise that moves the workpiece being held to the center of the vise. This can improve accuracy and precision in the machining process wherein these vises are very popular. In that these vises center the workpiece, both jaws must move relative to the base and relative to one another to either provide an inwardly or an outwardly directed clamping force that is centered within the vise base. In that both jaws must move, there must be sufficient clearance between the jaws and the guides of the vise body. However, this "clearance" can produce jaw lift that reduces machining accuracies, which will be discussed more below. In order to move the jaws relative to one another, most prior art self-centering vises have a threaded rod or lead screw that is rotatable about a screw axis and that can rotate relative to the vise body. The lead screw has a center point and includes a right-handed external thread on one side of the center point and a left-handed external thread at the other side of the center point. The jaws include a first jaw that has a right-handed internal thread and a second jaw that has a left-handed internal thread wherein the jaws rotationally engage the threaded rod on either side of the center point. As a result, rotation of the rod in a first rotational direction about the rod or screw axis moves the jaws toward one another and toward the center. And, rotation of the rod in the other rotational direction moves the jaws away from one another and away from the center point. Thus, rotation of the threaded rod causes the jaws to move towards or away from each other.

In that the accuracy of the self-centering vise depends on the vise accurately centering and locating the workpiece each time, some self-centering vises include an adjustable center point.

One issue with multi-jaw vises is the "jaw lift" noted above. In greater detail, precision machining requires the workpieces to be maintained and repeatably located within strict tolerances. Jaw lift in a vise makes it difficult to maintain strict tolerances in the workpieces. Jaw lift is when the movable jaws of the vise lift as the jaws compress the workpiece relative to one another. Such 'jaw-lift' may result in, for example, a workpiece being slightly out of position relative to a known coordinate location of the milling machine. Moreover, jaw lift can also occur during machining. As referenced above, there needs to be enough clearance between the jaws and the guides of the vise body to allow the jaws to move and this clearance can produce the jaw lift.

In view of the importance of preventing jaw lift, some prior art vises have incorporated elaborate structures to control the clearances between the jaws and the guides to prevent jaw lift. In one particular vise, which has been well received in the industry, the vise incorporates an array of set screws and strategically placed pad arrangements to prevent the unwanted jaw lift. While this design can reduce jaw lift, it is time consuming, it requires the use of an additional tool and it adds another parameter into workholding geometry. In this respect, this system requires two set screw and two pad arrangements per moveable jaw. Thus, these vises include four set screws that must be tightened and loosened each time a workpiece is clamped in the vise. Moreover, these four set screws must be manually loosened and then manually and accurately tightened each time the vise is used.

In greater detail, the four set screws engage four respective pads that are positioned below the jaws. When the set screws are tightened, they engage the pads and urge the jaw upwardly in the vise body guides. Each set screw urges one side of one of the jaws upwardly into one of the two vise body guides. The tightening of these two set screws removes the clearance between the vise body guides and one of the jaws in a known direction such that the jaw is forced against the upper guide surfaces of the vise body guides. Then, the same must be done to the other jaw since self-centering vises have two moveable jaws. This set screw tightening procedure must be done each time the jaws are adjusted or moved along the vise body guides. Then, before the jaws can be loosened or moved, all four set screws must be loosened to bring back the clearances that are needed to allow the jaws to move relative to the vise body guides.

As can be appreciated, this can be time consuming. And, it also requires a separate tool. Yet even further, the threads of the screws and/or threaded holes can become stripped if they are over tightened, which can make this feature inoperable and/or require expensive repairs. Moreover, in view of the time associated with tightening and then loosening the plurality of set screws, there is also the risk that this feature is not properly utilized by shop personnel.

Another issue is the centering of the jaws of the vise. In this respect, it is also important to set the center of the vise. Prior art vises includes means to make this adjustment, but it has been found that these systems can be ineffective, inaccurate, overly complicated and/or require special tools.

SUMMARY OF THE INVENTION

The invention of this application relates to vises and more particularly to multiple moveable jaw vises that overcome many of the shortcomings in the prior art. Even more particularly, the invention of this application relates to vise structures that have been found to work particularly well in connection with self-centering vises wherein the invention of this application will be discussed with specific reference to self-centering vises even though this application is not to be limited to a particular style of vise.

According to one aspect of the invention of this application, the vise includes one or more vise components configured to prevent jaw lift.

According to certain embodiments of the invention of this application, the vise includes vise trucks that move along a vise axis and vise jaws fixed relative to the vise trucks and wherein the vise jaws can automatically move relative to the vise trucks to urge the jaws toward the trucks when the vise is tightened and to allow the jaws to automatically move away from the trucks when the jaw is loosened.

According to yet other embodiments of the invention of this application, the vise includes a vise lead screw having a center point that rotates about a screw axis that is parallel to the vise axis wherein the vise trucks are on either side of the center point and move relative to the vise base when the lead screw is rotated about the screw axis. The lead screw being transversely displaceable relative to the screw axis to help facilitate the movement of the trucks relative to the vise jaws.

According to another aspect of the invention of this application, the vise includes one or more vise components configured to produce an efficient centering feature to center the moveable jaws within the jaw body.

According to certain embodiments of the invention of this application, the vise includes an axially displaceable pillow block assembly to provide selective unified displacement of the vise jaws, the vise trucks and the lead screw relative to the vise base along the vise axis.

These and other objects, aspects, features and advantages of the invention will become apparent to those skilled in the art upon a reading of the Detailed Description of the invention set forth below taken together with the drawings which will be described in the next section.

BRIEF DESCRIPTION OF THE DRAWINGS

The foregoing, and more, will in part be obvious and in part be pointed out more fully hereinafter in conjunction with a written description of preferred embodiments of the present invention illustrated in the accompanying drawings in which.

DETAILED DESCRIPTION OF EMBODIMENTS

Figure 1:
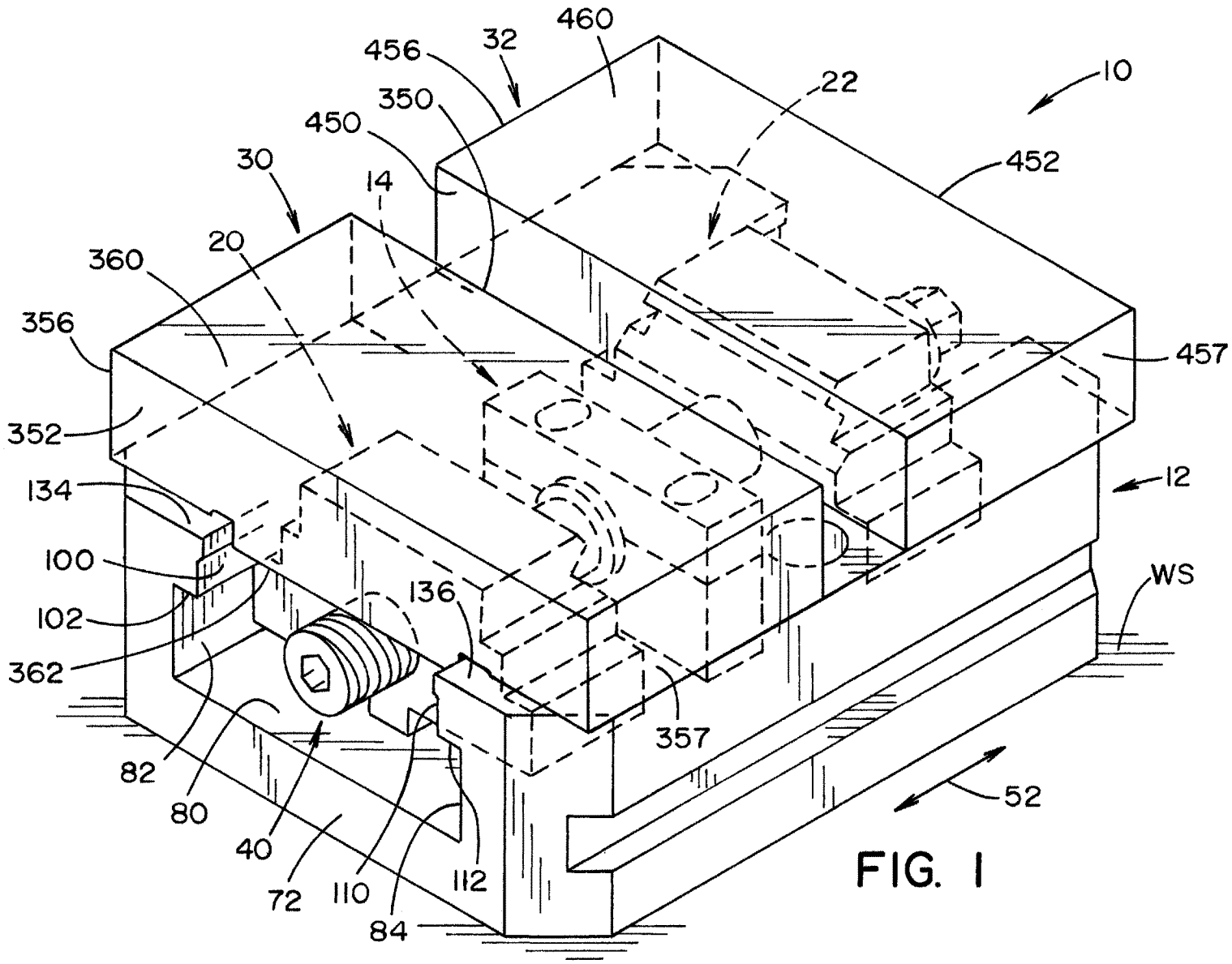
FIG. 1 is a perspective view of a vise according to certain aspects of the present invention.
Figure 2:
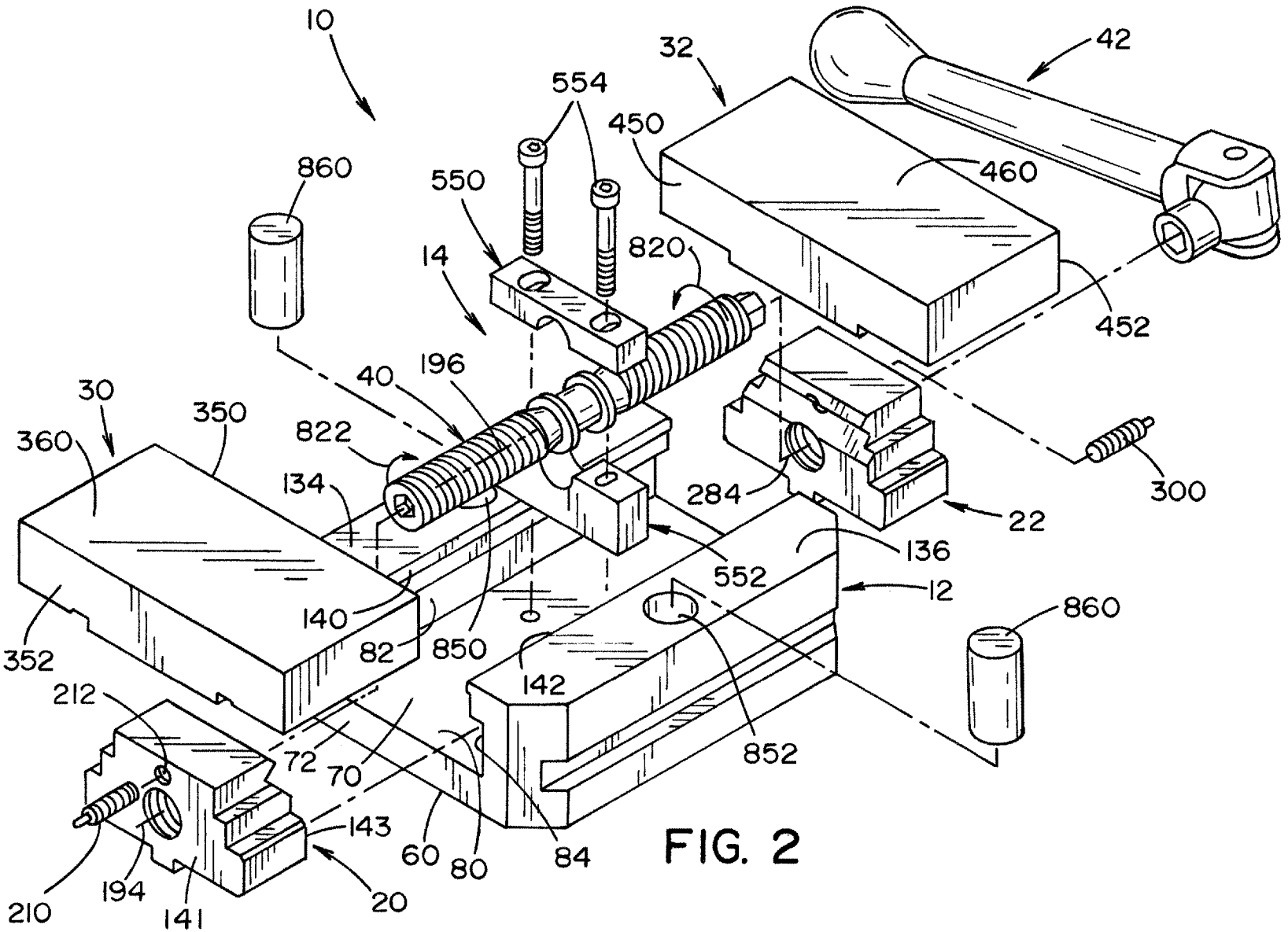
FIG. 2 is an exploded perspective view of the vise shown in FIG. 1.
Figure 3:
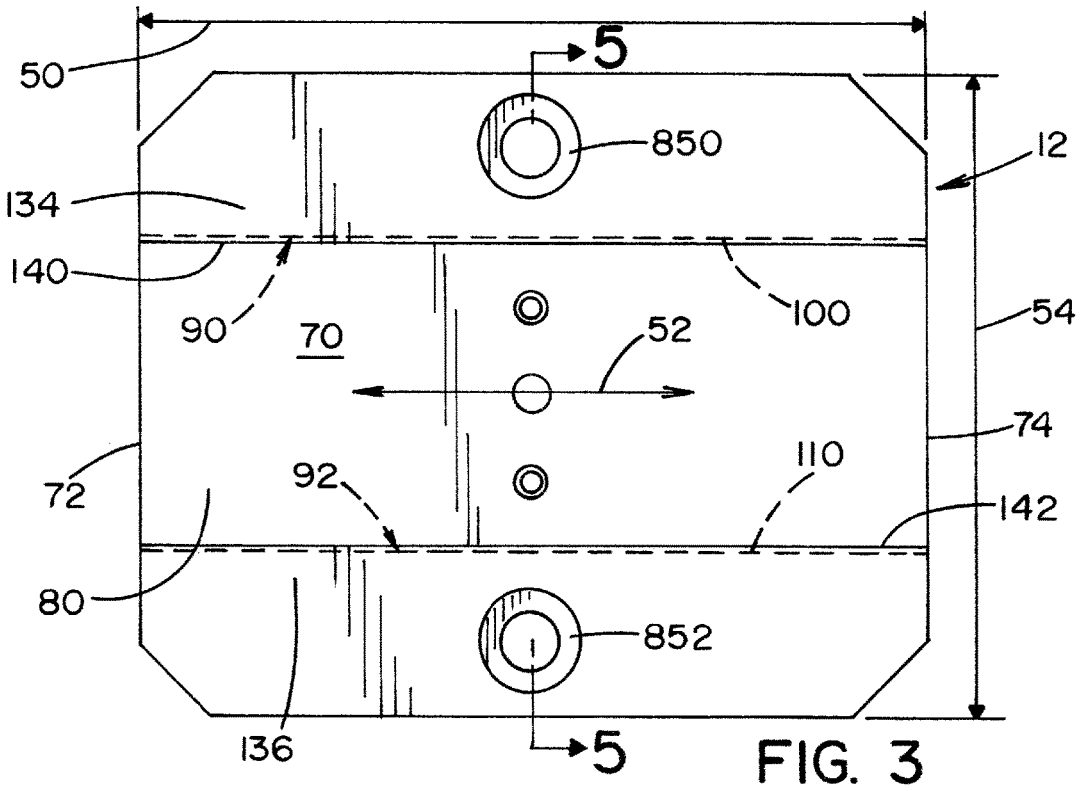
FIG. 3 is a top view of a vise body for the vise shown in FIG. 1.
Figure 4:
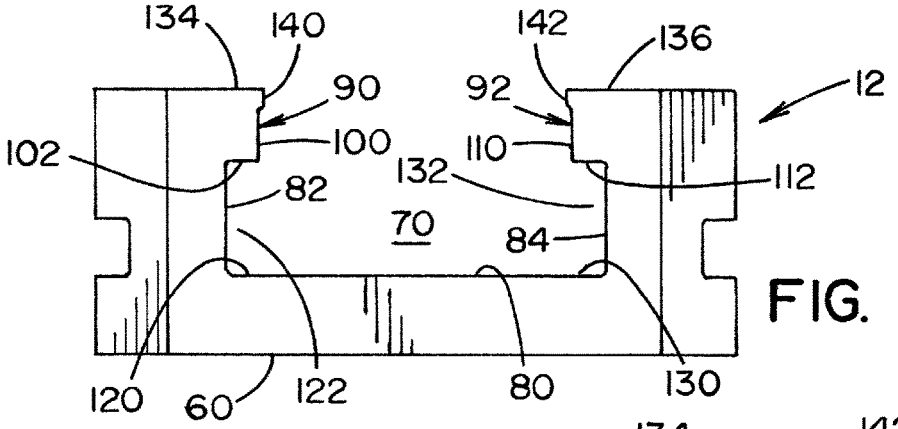
FIG. 4 is an end view of the vise body shown in FIG. 3.
Figure 5:
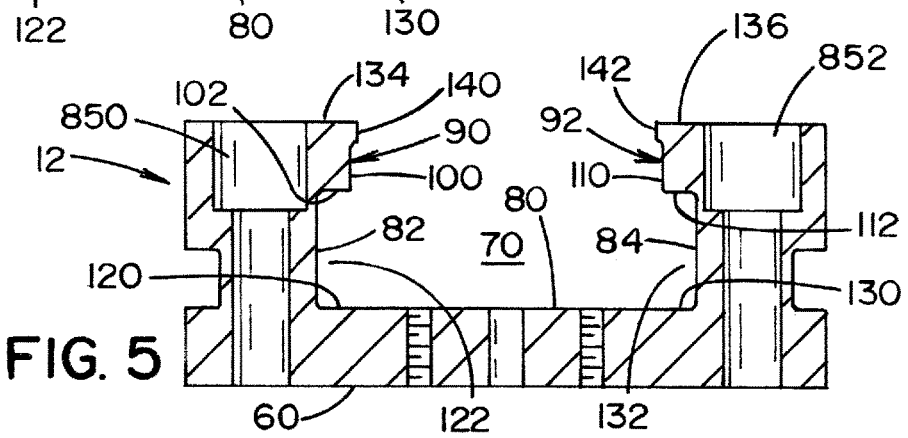
FIG. 5 is a sectional view along line 5-5 in FIG. 3.
Figure 6:
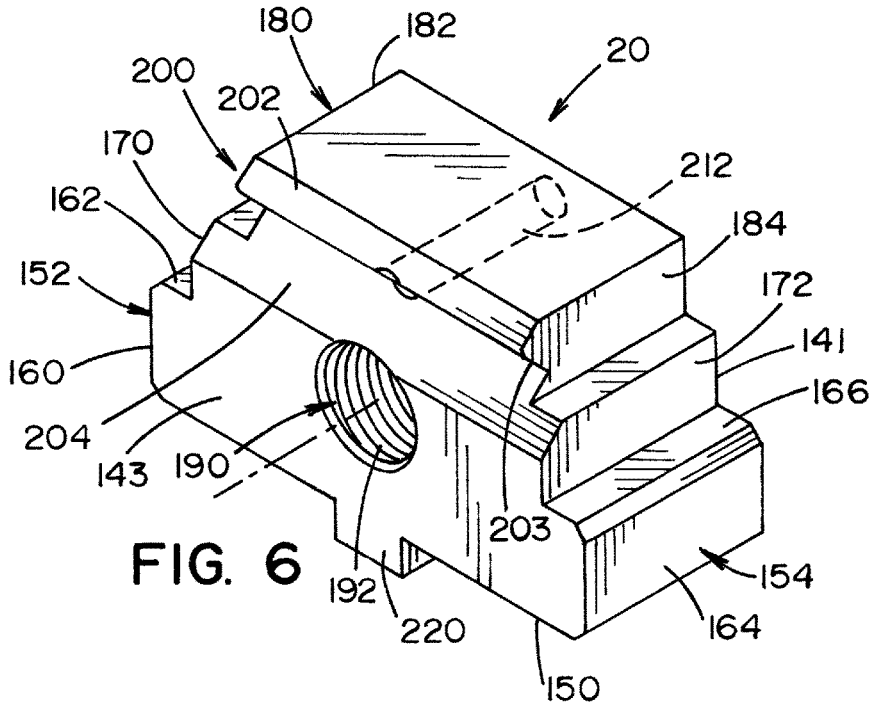
FIG. 6 is a perspective view of a first truck for the vise shown in FIG. 1.
Figure 7:
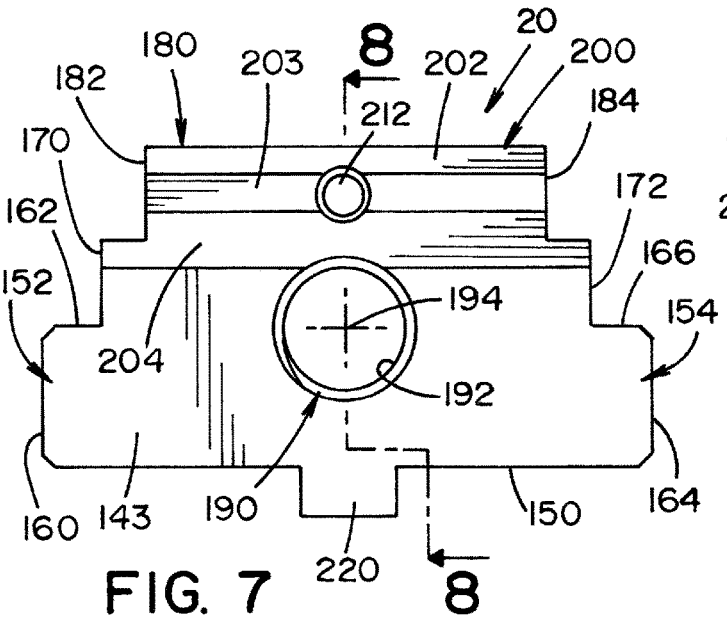
FIG. 7 is an elevational view of the first truck shown in FIG. 6.
Figure 8:
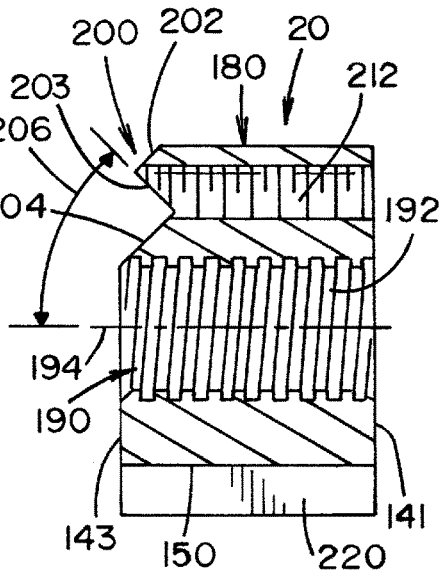
FIG. 8 is a sectional view taken along line 8-8 in FIG. 7.
Figure 9:
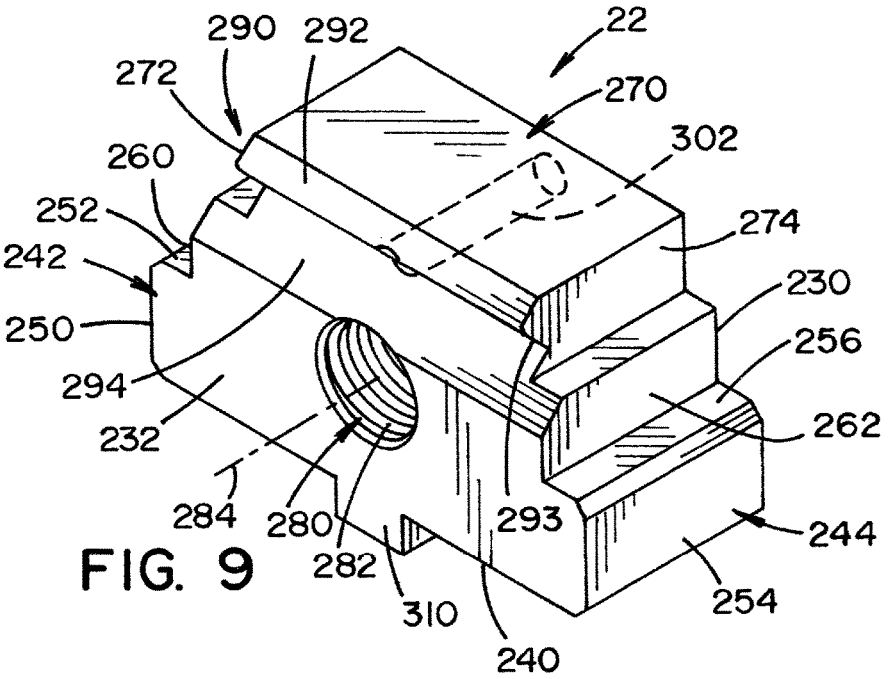
FIG. 9 is a perspective view of a second truck for the vise shown in FIG. 1; and, FIG. 10 is an elevational view of the second truck shown in FIG. 9.
Figure 10:
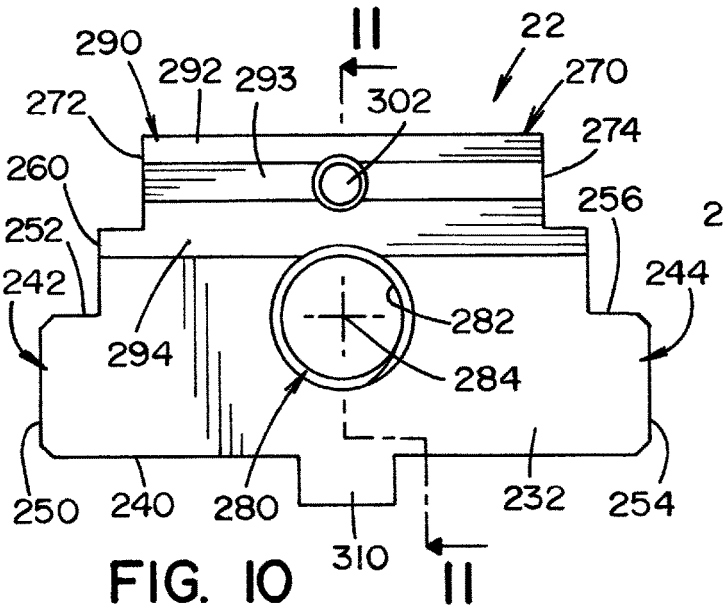
Figure 11:
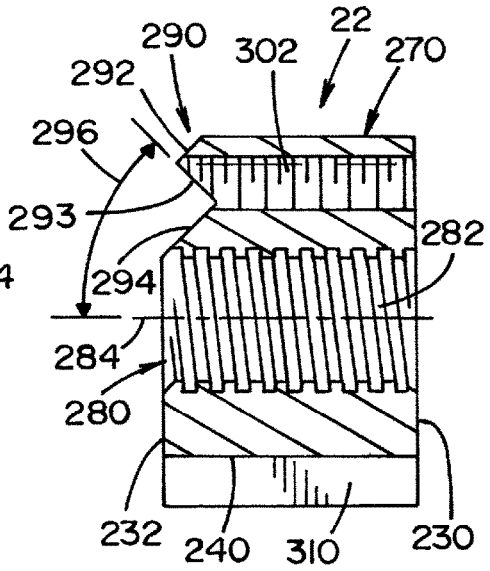
FIG. 11 is a sectional view taken along line 11-11 in FIG. 10.
Figure 12:
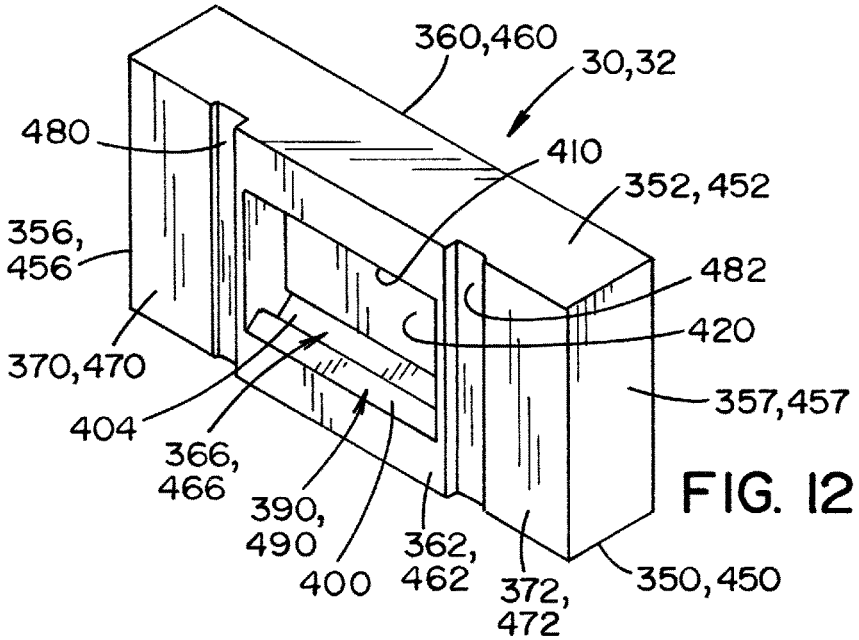
FIG. 12 is a bottom side perspective view of a jaw for the vise shown in FIG. 1.
Figure 14:
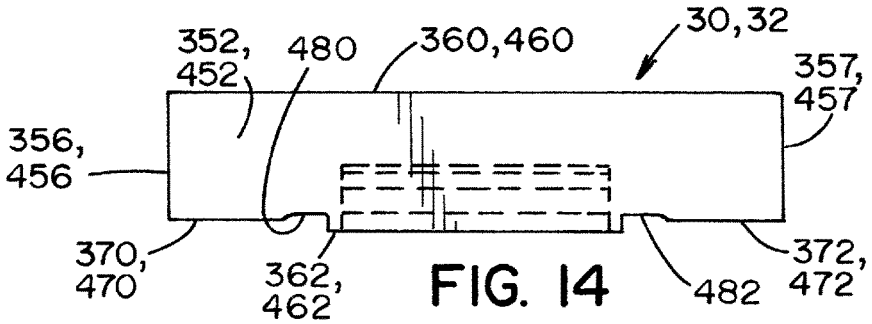
FIG. 14 is an elevational view of the jaw shown in FIG. 12.
Figure 15:
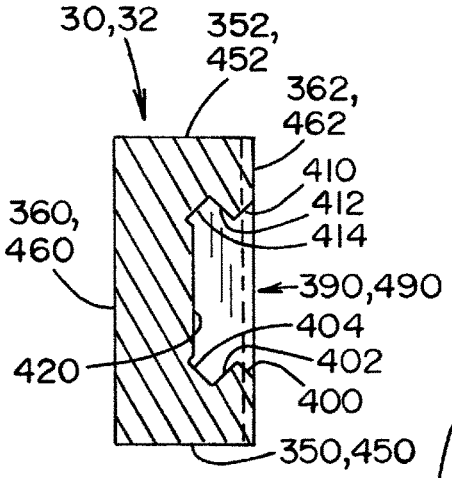
FIG. 15 is a sectional view taken along line 15-15 in FIG. 13.
Figure 13:
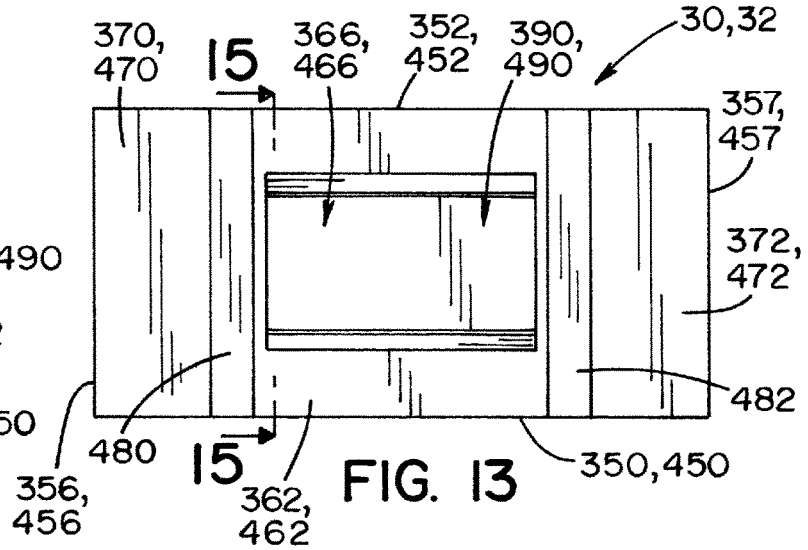
FIG. 13 is a bottom view of the jaw shown in FIG. 12.
Figure 16:
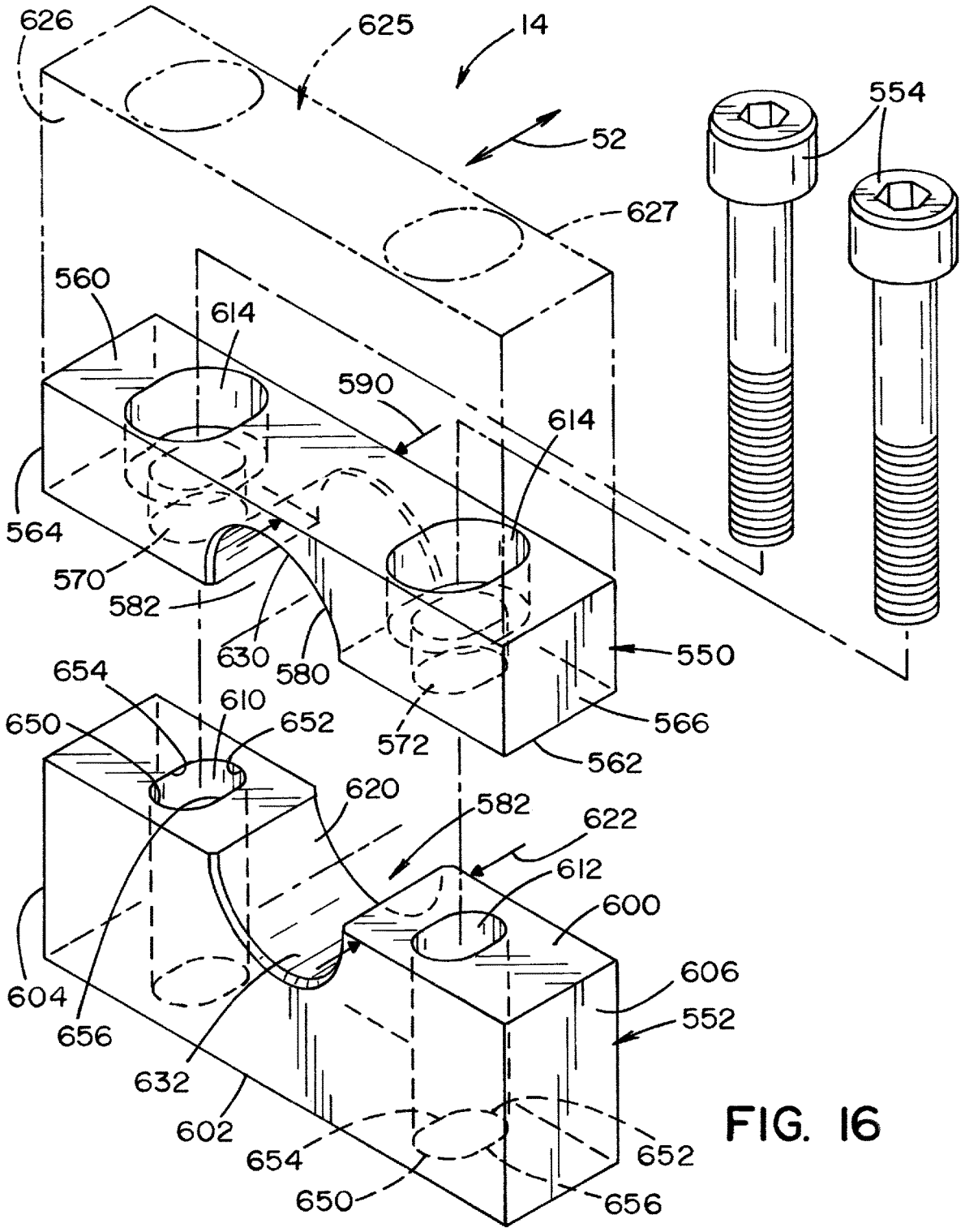
FIG. 16 is an exploded sectional view of a pillow block for the vise shown in FIG. 1.
Figure 17:
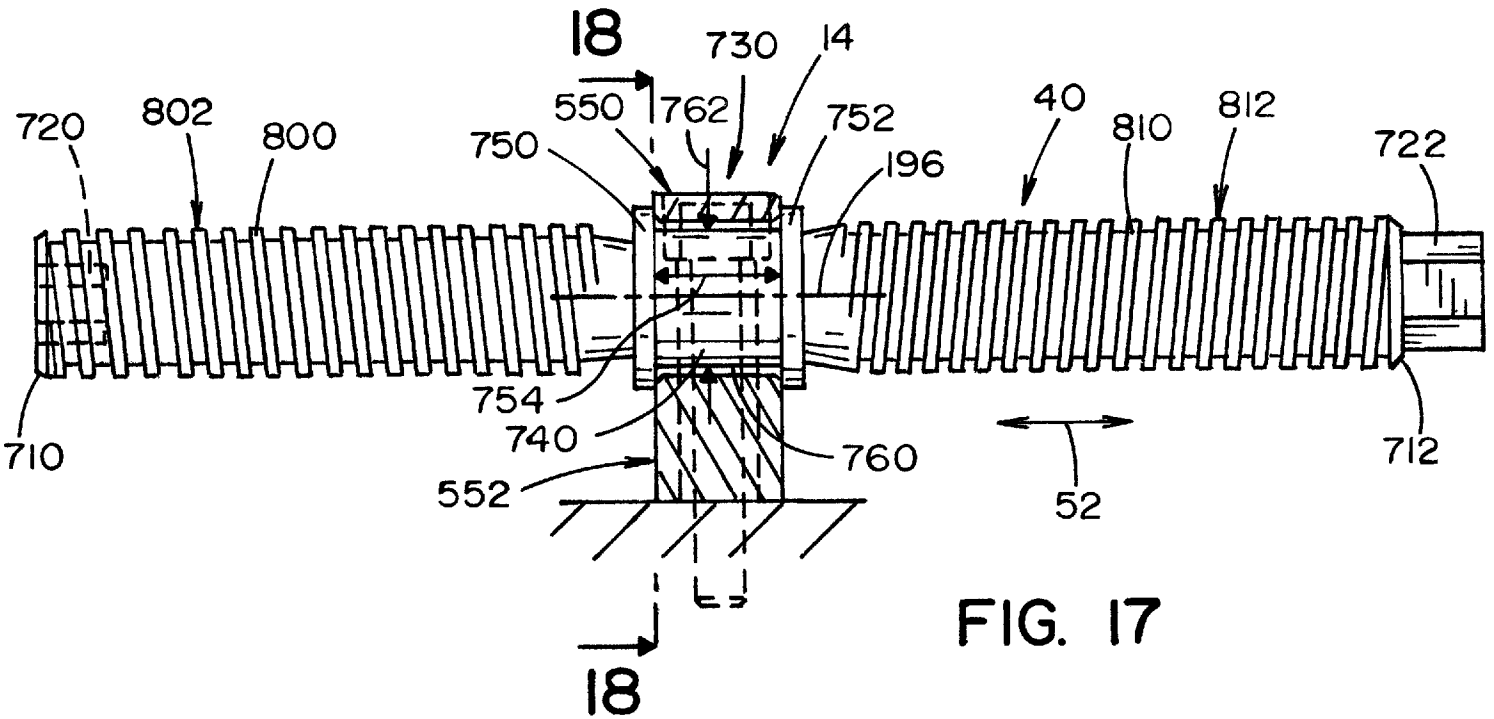
FIG. 17 is an elevational view of a lead screw for the vise shown in FIG. 1 with a sectional view of the pillow block.
Figure 18:
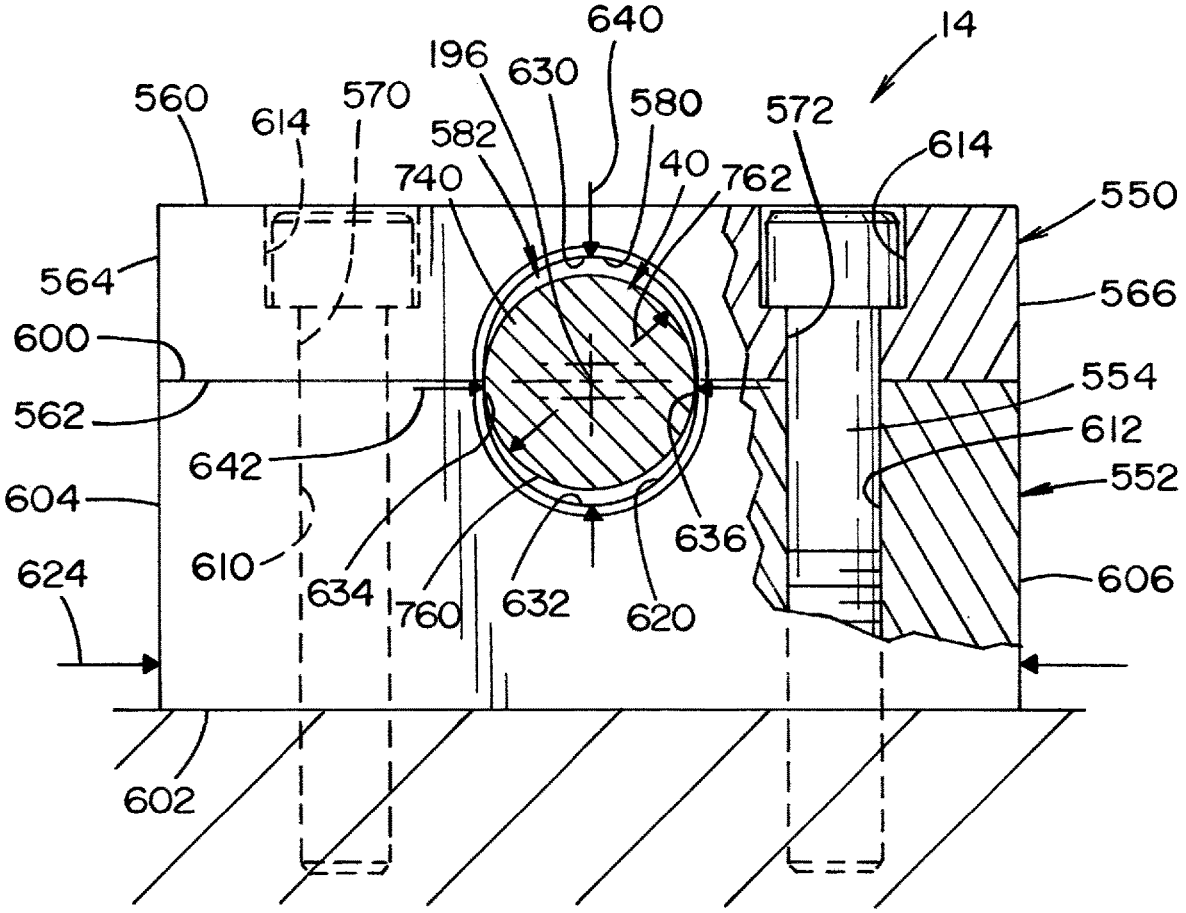
FIG. 18 is a sectional view taken along line 18-18 in FIG. 17.

Referring now to the drawings wherein the showings are for the purpose of illustrating preferred and alternative embodiments of the invention only and not for the purpose of limiting the same, FIG. 1—show a two jaw vise 10 which generally includes a vise body or base 12, a central pillow block assembly 14, a first truck 20, a second truck 22, a first jaw 30, a second jaw 32 and a lead screw 40. The vise can further include a vise handle assembly 42

As is known in the art, jaws 30 and 32 are configured to move relative to vise base 12 toward and away from one another and function to clamp a workpiece WP between the vise jaws. Again, while a specific vise configuration and vise base is shown, the invention of this application can be utilized in a wide range of vise configurations without detracting from the invention of this application including, but not limited to, a wide range of jaw configurations, single jaw vises, multiple jaw vises, multiple station vises, self-centering vises, 5-axis machining vises, multi axis machining vises and multi-station vises. Moreover, reference to directions and/or positions in this specification are in reference to the drawings only and are not to limit the invention of this application, including, but not limited to, top, bottom, upper, lower, middle, left, right.

Base 12 has a length 50 extending in a longitudinal direction 52 and a width 54 transverse to the longitudinal direction. Base 12 can be produced by any method known in the art including, but not limited to, a machined solid block, an extrusion and/or an assembly of separate parts without detracting from the invention. As is shown, base 12 is a machined solid block. Base 12 can include any mounting arrangement known in the art to secure the vise, which includes those found in the prior art.

Base 12 includes a base bottom 60 that can include the mounting arrangements reference above. Base 12 has a longitudinally extending guide channel 70 that can extend from a first vise end 72 to a second vise end 74. Guide channel 70 is parallel to longitudinal direction 52 and can have a wide range of configurations without detracting from the invention of this application. As is shown, guide channel includes a bottom surface 80, a first side surface 82 extending upwardly from one side of bottom surface 80 and a second side surface 84 extending upwardly from the other side of bottom surface 80. Guide channel 70 further includes a first inwardly extending flange 90 above first side surface 82 and a second inwardly extending flange 92 above second side surface 84. First flange 90 includes a first inwardly facing edge or surface 100 and a first downwardly facing edge or surface 102 and second flange 92 includes a second inwardly facing edge or surface 110 and a second downward edge or surface 112 wherein edges 100 and 110 face one another and wherein edges 102 and 112 are generally parallel to one another and face bottom surface 80. In combination, first downward edge 102, first side surface 82 and a first portion 120 of bottom surface 80 form a first truck channel 122. Similarly, second downward edge 112, second side surface 84 and a second portion 130 of bottom surface 80 form a second truck channel 132. Moreover, the first and second flanges can include one or more chip flanges 140 and 142, respectively, that can be used to maintain needed clearances when the vise is being used in a machining operation. Vise base 12 further includes a first base upper guide surface 134 on one side of guide channel 70 and a second base upper guide surface 136 on the other side of channel 70 that both extend longitudinally. As is shown, surfaces 134 and 136 are upwardly facing surfaces, which will be discussed more below.

First truck 20 has a first outside face 141 and a first inside face 143 longitudinally spaced from the first outside face when in an assembled condition as is shown in the illustrated embodiment. First truck 20 includes a bottom edge or surface 150 and oppositely extending first truck flanges 152 and 154 on either end of bottom edge 150. Truck flange 152 includes an outer edge or surface 160 and an upper surface 162 and truck flange 154 includes an outer edge or surface 164 and an upper surface 166. Extending upwardly from truck flange 152 is a guide surface 170 and extending upwardly from truck flange 154 is a guide surface 172 wherein guides surfaces 170 and 172 are generally parallel to one another. First truck 20 further includes a first jaw mount 180 that includes opposite side surfaces 182 and 184. Below first jaw mount 180 is a first threaded lead screw opening 190 having a first truck lead screw thread 192, which can be either a right hand or a left hand thread and which extends about first truck thread axis 194. When in an assembled condition as is shown in FIG. 1, first truck thread axis 194 is coaxial with a lead screw axis 196 of lead screw 40, which will be discussed more below. First jaw mount 180 includes a first inwardly extending jaw lift control projection 200, which will be discussed more below.

Jaw lift control projection 200 includes an upper control surface 202, a middle control surface 203 and a lower control surface 204 that are angled relative to one another as is shown. Middle control surface 203 is at a control angle 206 relative to first truck thread axis 194. Control angle 206 can be between 20 degrees and 70 degrees. More particularly, control angle 206 is between 30 degrees and 60 degrees. More particularly, control angle 206 is between 40 degrees and 50 degrees. In one embodiment, control angle 206 is about 45 degrees. Upper control surface 202 can also be parallel to lower control surface 204 and/or perpendicular to middle control surface 203.

First truck 20 further includes a first spring plunger assembly 210 extending from outside face 141 and that extends from a spring plunger opening 212. First spring plunger 210 can be any spring plunger (or the like) without detracting from the invention of this application and can be used in connection with surfaces 202-204 to secure the jaw relative to the truck while allowing controlled movement between the jaw and the truck. In addition, first truck 20 can include one or more first bottom ribs 220. It has been found that first bottom rib 220 can be used to help first truck 20 work in the harsh environments associated with machining operations to prevent chips, which are produced from machining, from preventing movement or causing jamming of the truck within the guide channel. Moreover, it has been found that first rib 220 can also reduce lead screw flex during clamping and improve clamp load.

Second truck 22 can be like first truck 20, but this is not required. In this respect and as is shown, second truck 22 has a second outside face 230 and a second inside face 232 longitudinally spaced from the second outside face when in the assembled condition. Second truck 22 includes a bottom edge or surface 240 and oppositely extending second truck flanges 242 and 244 on either end of bottom edge 240. Truck flange 242 includes an outer edge or surface 250 and an upper surface 252 and truck flange 244 includes an outer edge or surface 254 and an upper surface 256. Extending upwardly from truck flange 242 is a guide surface 260 and extending upwardly from truck flange 244 is a guide surface 262 wherein guides surfaces 260 and 262 are generally parallel to one another. Second truck 22 further includes a second jaw mount 270 that includes opposite side surfaces 272 and 274. Below second jaw mount 270 is a second threaded lead screw opening 280 having a second truck lead screw thread 282, which is coaxial with a second screw thread axis 284. Truck thread 282 can be either a right hand or a left hand thread, but is preferably the opposite of first truck lead screw thread 192. When in an assembled condition as is shown in FIG. 1, second screw truck thread axis 284 is also coaxial with lead screw axis 196 of lead screw 40, which will be discussed more below. Second jaw mount 270 includes a second inwardly extending jaw lift control projection 290, which will be discussed more below.

Jaw lift projection 290 includes an upper control surface 292, a middle control surface 293 and a lower control surface 294 that are angled relative to one another. Middle control surface 293 is at a control angle 296 relative to second screw truck thread axis 284. Control angle 296 can be between 20 degrees and 70 degrees. More particularly, control angle 296 is between 30 degrees and 60 degrees. More particularly, control angle 296 is between 40 degrees and 50 degrees. In one embodiment, control angle 296 is about 45 degrees. Upper control surface 292 can also be parallel to lower control surface 294 and/or perpendicular to middle control surface 293.

Second truck 22 further includes a second spring plunger assembly 300 extending from outside face 230 and that extends from a spring plunger opening 302. Second spring plunger assembly 300 can be any spring plunger (or the like) and can be the same as spring plunger assembly 210 without detracting from the invention of this application. Second spring plunger assembly 300 can be used in connection with surfaces 292-294 to secure the jaw relative to the truck while allowing controlled movement between the jaw and the truck, which will be discussed in greater detail below. In addition, second truck 22 can include one or more second bottom ribs 310. Again, it has been found that second bottom rib 310 can be used to help second jaw 22 work in the harsh environments associated with machining operations to prevent jamming of the truck within the guide channel. Moreover, the second rib 310 can reduce lead screw flex and improve clamp load.

First and second jaws 30 and 32 can have any known jaw configuration without detracting from the invention of this application wherein the jaws shown are for example only. Moreover, jaws 30 and 32 can be made from a wide range of materials without detracting from the invention of this application including, but not limited to, materials having different hardnesses.

In greater detail, first and second jaws 30 and 32 as are shown in the illustrated embodiments are identical; however, this is not required. In the interest of brevity, part of jaws 30 and 32 will be described together. includes a first jaw clamping surface or face 350 and a back face 352. While clamping surface or face 350 is shown to be an inwardly facing surface, this is not required. First jaw 30 further includes first side jaw edges 356 and 357 that can be parallel to one another. First jaw 30 further includes a first jaw top 360 and a first jaw bottom 362. First jaw 30 further includes a first truck mount 366 that is shaped to receive first jaw mount 180 discussed above. As is shown, first truck mount can be positioned relative to first jaw bottom 362. First jaw 30 further includes two jaw guide surfaces 370 and 372, which can be on either side of first truck mount 366. Jaw guide surfaces 370 and 372 can include relief portions.

First truck mount 366 includes a first truck pocket 390 having a configuration to receive at least a portion of first jaw mount 180 and first inwardly extending jaw lift control projection 200. First truck pocket 390 includes at least one lifting surface wherein the at least one lifting surface in the embodiments shown includes a front lower surface 400, a front middle surface 402, a front upper surface 404, a rear lower surface 410, a rear middle surface 412 and a rear upper surface 414. First pocket 390 can further include a top surface 420 and one or more reliefs. As is shown, top surface 420 can join front upper surface 404 and rear upper surface 414, but this is not required. Moreover, while many surfaces of this application are shown as planar surfaces, this is not required wherein they should not be limited to planar surfaces. While not required, front surfaces 400, 402 and 404 can have the same or similar configuration as rear surfaces 410, 412 and 414. First truck mount 366 can extend from first jaw bottom 362 forming truck mount side surfaces, which can be configured to extend into guide channel 70 when in the assembled condition.

Again, the first and second jaws can be the same configuration as is shown in the drawings, but this is not required. As is shown, second jaw 32 includes a second jaw clamping surface or face 450 and a back face 452. Again, while clamping surface or face 450 is shown to be an inwardly facing surface, this is not required. Second jaw 32 further includes second side jaw edges 456 and 457 that can be parallel to one another. Second jaw 32 further includes a second jaw top 460 and a second jaw bottom 462. Second jaw 32 further includes a second truck mount 466 that is shaped to receive second jaw mount 270 discussed above. As is shown, second truck mount 466 can be positioned relative to second jaw bottom 462. Second jaw 32 further includes two jaw guide surfaces 470 and 472, which can be on either side of second truck mount 466. Jaw guide surfaces 470 and 472 can include relief portions 480 and 482, respectively.

Second truck mount 466 includes a second truck pocket 490 having a configuration to receive at least a portion of second jaw mount 270 and second inwardly extending jaw lift control projection 290. Second truck pocket 490 includes at least one lifting surface wherein the at least one lifting surface in the embodiments shown includes the same surfaces as jaw 30. As with jaw 30, jaw 32 includes a front lower surface 400, a front middle surface 402, a front upper surface 404, a rear lower surface 410, a rear middle surface 412 and a rear upper surface 414. Second pocket 490 can further include a top surface 420 and one or more reliefs. As is shown, top surface 420 can join front upper surface 404 and rear upper surface 414, but this is not required. While not required, front surfaces 400, 402 and 404 can have the same or similar configuration as rear surfaces 410, 412 and 414. Second truck mount 466 can extend from bottom second jaw bottom 462 forming truck mount side surfaces, which can be configured to extend within guide channel 70 when in the assembled condition.

Again, jaws 30 and 32 can have a wide range of configurations without detracting from the invention of this application wherein the drawings of this application merely show one of the many possible configurations.

Pillow block assembly 14 can have a wide range of configurations without detracting from the invention of this application as is the case for other structures of this application. As is shown in the illustrated embodiments, pillow block 14 has a two piece design having a top pillow block portion 550, a bottom pillow block portion 552 and pillow block fasteners 554. Top pillow block 550 includes a top pillow block upper edge 560, a top block lower edge 562 and top block side edges 564 & 566. Top pillow block 550 further includes top block fastener openings 570 and 572. Top pillow block further includes a top block opening portion 580 of a lead screw opening 582. Top block opening portion 580 extends inwardly from top block lower edge 562 and top block opening portion 580 is preferably centered in lower edge 562, but this is not required. Top pillow block 550 has a top block thickness 590 at least near lead screw opening 582.

Bottom pillow block 552 includes a bottom block upper edge 600, a bottom block lower edge 602 and bottom block side edges 604 & 606. Bottom pillow block 552 further includes bottom block fastener openings 610 and 612. Bottom pillow block further includes a bottom block opening portion 620 of lead screw opening 582. Bottom block opening portion 620 extends inwardly from bottom block upper edge 600 and bottom block opening portion 620 is preferably centered in upper edge 600, but this is not required. Bottom pillow block 552 has a bottom block thickness 622 at least near lead screw opening 582.

Top pillow block 550 and bottom pillow block 552 are configured to be securable relative to one another to form pillow block assembly 14 and are sized to allow pillow block assembly 14 to fit within guide channel 70. This can include a pillow block assembly width 624 that allows the assembly to fit within guide channel 70 and selectively move within the channel as will be discussed more below. Moreover, top block fastener openings 570 and 572 and/or bottom block fastener openings 610 and 612 can be slotted openings in longitudinal direction 52 (when in the assembled condition shown in FIG. 1) to allow selective and controlled longitudinal movement or adjustment of pillow block assembly 14 relative to vise base 12 in longitudinal direction 52 within guide channel 70, which will also be discussed more below. Fastener openings 570 and 572 can further include a countersink 614.

Yet even further, pillow block assembly 14 and/or vise 10 can include a center jaw 625 that can create a two workpiece vise design. In this set of embodiments, center jaw can include a first center jaw clamping surface or face 626 facing first jaw clamping surface or face 350 and a second center jaw clamping surface or face 627 facing second jaw clamping surface or face 450. According, vise 10 can have two operable work stations wherein the first work station is between faces 626 and 350 and the second one is between faces 627 and 450. Center jaw 625 can be a fixed jaw and can be centered in the same way as the pillow block assembly, which will be discussed more below. Center jaw 625 can come in a wide range of variations without detracting from the invention of this application. Moreover, center jaw 625 can be part of and/or extension of the central pillow block assembly and/or an attachment to the pillow block assembly. As is shown, center jaw 625 can be a modification of top pillow block 550 wherein the jaws and pillow blocks can be centered simultaneously as will be discussed more below.

Lead screw opening 582, which is formed by top and bottom block opening portions 580 and 620, can also be slotted to allow transverse movement of lead screw 40 relative to pillow block assembly 14 and longitudinal direction 52. In greater detail, lead screw opening 582 includes a slotted configuration transverse to longitudinal direction 52. Lead screw opening 582 includes a top screw arcuate portion 630 and a bottom screw arcuate portion 632 and upwardly extending opening screw side edges 634 & 636, which extend between top screw arcuate portion 630 and bottom screw arcuate portion 632. Top screw arcuate portion 630, bottom screw arcuate portion 632 and screw side edges 634 & 636 define a lead screw opening height 640 and a lead screw opening width 642 wherein lead screw opening height 640 is greater than lead screw opening width 642. In that opening side edges 634 & 636 are transverse to longitudinal direction 52 and lead screw opening height 640 is greater than lead screw opening width 642, lead screw opening 582 is configured to allow selective transverse movement of lead screw 40 toward and away from base upper guide surfaces 134 and 136 to allow for controlled and limited transverse movement of the trucks and the jaws to prevent jaw lift, which will be discussed more below.

As is shown, fastener openings 570, 572, 610 and 612 include a slotted configuration parallel to longitudinal direction 52 when in the assembled condition. In greater detail, fastener openings 570, 572 610 and 612 include a first fastener arcuate portion 650 and a second fastener arcuate portion 652 and longitudinally extending opening fastener side edges 654 & 656, which extend between first fastener arcuate portion 650 and second fastener arcuate portion 652. In that side edges 654 & 656 are parallel to longitudinal direction 52, they allow selective movement of pillow block assembly 14 in the longitudinal direction and, thus, lead screw 40 in longitudinal direction 52 when pillow block fasteners 554 are loosened. This in turn produces selective and unified movement of the trucks and the jaws with the pillow block and the lead screw in the longitudinal direction. This unified longitudinal movement of the pillow block assembly, lead screw, trucks and jaws can be used to adjust or calibrate the center point of the lead screw relative to the vise base, which will be discussed more below.

Lead screw 40 extends in longitudinal direction 52 wherein lead screw axis 196 is at least generally parallel to longitudinal direction 52 and forms a vise axis. However, as will be discussed more below, the controlled transverse movement of the jaws and/or trucks to prevent jaw lift could result in the lead screw axis being at least slightly unparalleled to longitudinal direction 52. Lead screw 40 extends between a first lead screw end 710 to a second lead screw end 712. First lead screw end 710 can include a first tool engaging configuration 720 and second lead screw end can include a second tool engaging configuration 722. First and second tool engaging configurations 720 and 722 can be the same configuration and/or can include different configurations as is shown in the drawings. As is shown, first tool engaging configuration is a hex socket head and second tool engaging configuration is a hex head. Vise handle assembly 42 can be configured to engage first and/or second tool engaging configurations and can be any handle assembly known in the art without detracting from the invention of this application.

Lead screw 40 further includes a center point 730 between first and second ends 710 and 712. Center point 730 can be an adjustable center point based on the adjustability of pillow block assembly 14, which will be discussed more below. Lead screw 40 further includes a longitudinally extending central groove 740, which is preferably cylindrical. Groove 740 is shaped to be received within lead screw opening 582 wherein the slotted configuration of lead screw opening 582 allows for the transverse movement of lead screw 40 as referenced above and which will be discussed more below. Central groove 740 is coaxial with lead screw axis 196 and includes a first groove wall 750 and a second groove wall 752 that is axially spaced from first groove wall 750 by a groove spacing 754. Groove spacing 754 is larger than pillow block assembly width 590, 622 to allow pillow block assembly 14 to capture and secure lead screw 40 longitudinally within central groove 740, but allow relative rotation of lead screw 40 about lead screw axis 196. Preferably, groove spacing 754 is only slightly larger than pillow block assembly 14 width 590, 622 to limit unwanted longitudinal movement of lead screw 40. Central groove 740 can further include a cylindrical groove bearing surface 760 having a groove diameter 762 between the groove walls. Groove diameter 762 can be closely sized to lead screw opening width 642 to allow controlled rotation of the lead screw about the lead screw axis, but less than lead screw opening height 640 to allow for the transverse movement of lead screw 40 relative to block 14 and base 12. Lead screw 40 includes a first screw thread 800 on a first screw side 802 and a second screw thread 810 on a second screw side 812. First screw thread 800 is configured to threadingly engage with first truck lead screw thread 192 of first threaded lead screw opening 190 of first truck 20. Similarly, second screw thread 810 is configured to threadingly engage with second truck lead screw thread 282 of second threaded lead screw opening 280 of second truck 22. These threaded engagements produce longitudinal movement of the first and second trucks toward one another when lead screw 40 is rotated about lead screw axis 196 in a first rotational direction 820 and away from one another when rotated in a second rotational direction 822. Movement of the trucks in turn produces movement of the first and second jaws. Similarly, movement of the jaws can produce movement of the trucks.

In operation, vise 10 is positioned on a work surface WS. As noted above, any mounting feature and/or configuration known in the art can be used to secure vise base 12 of vise 10 relative to the work surface. Once secured to the work surface, pillow block fasteners 554 can be loosened to allow pillow block assembly 14 to be selectively moved in longitudinal direction 52. This movement can be used to adjust center point 730 of lead screw 40 and the vise as is desired to center the vise on the work surface. In that lead screw is held relative to the pillow block assembly longitudinally, longitudinal movement of the pillow block moves lead screw 40 longitudinally. Moreover, the longitudinal movement of lead screw 40 also moves trucks 20 & 22 and jaws 30 & 32 together in the longitudinal direction. Similarly, when pillow block fasteners 554 are loose, movement of jaws 30 & 32 can move trucks 20 & 22, which in turn will move lead screw 40, which will move pillow block assembly 14. According to one set of embodiments, vise base 12 can further include center alignments openings 850 and 852. Center alignments openings 850 and 852 can be shaped to receive alignment dowels or pins 860. In this embodiment, the vise can be quickly and accurately centered with the use of pins 860. In this respect, once vise 10 is positioned on the work surface, pins 860 are positioned into alignments openings 850 and 852 and pillow block fasteners 554 are loosened. Then, lead screw 40 can be rotated to move jaws 30 & 32 toward the center point and toward pins 860 in openings 850 and 852. As jaws 30 & 32 approach pins 860, one of the jaws will engage pins 860 first if the jaws are not centered. In that pillow block fasteners 554 are loose, the engagement between the one jaw and pin 860 will stop the inward movement of the one jaw and urge the other jaw toward the pins, which will move pillow block 14 toward the center of the vise. Continued tightening of the lead screw until both jaws are firmly engaged against either side of pins 860 will automatically center the pillow block assembly, the lead screw, the trucks, and the jaws. Once in the centered position, pillow block fasteners 554 can be tightened to maintain the pillow block assembly, lead screw, trucks and jaws in the centered position. Therefore, this movement can be used to center the jaws relative to the vise and; therefore, the work surface being used. Yet even further, it has been found that accuracy is further improved if pins 860 are cylindrical. In this respect, by utilizing cylindrical pins, each jaw/pin engagement point is in point contact wherein each jaw has two repeatable points of contact with the two pins.

Figure 19:
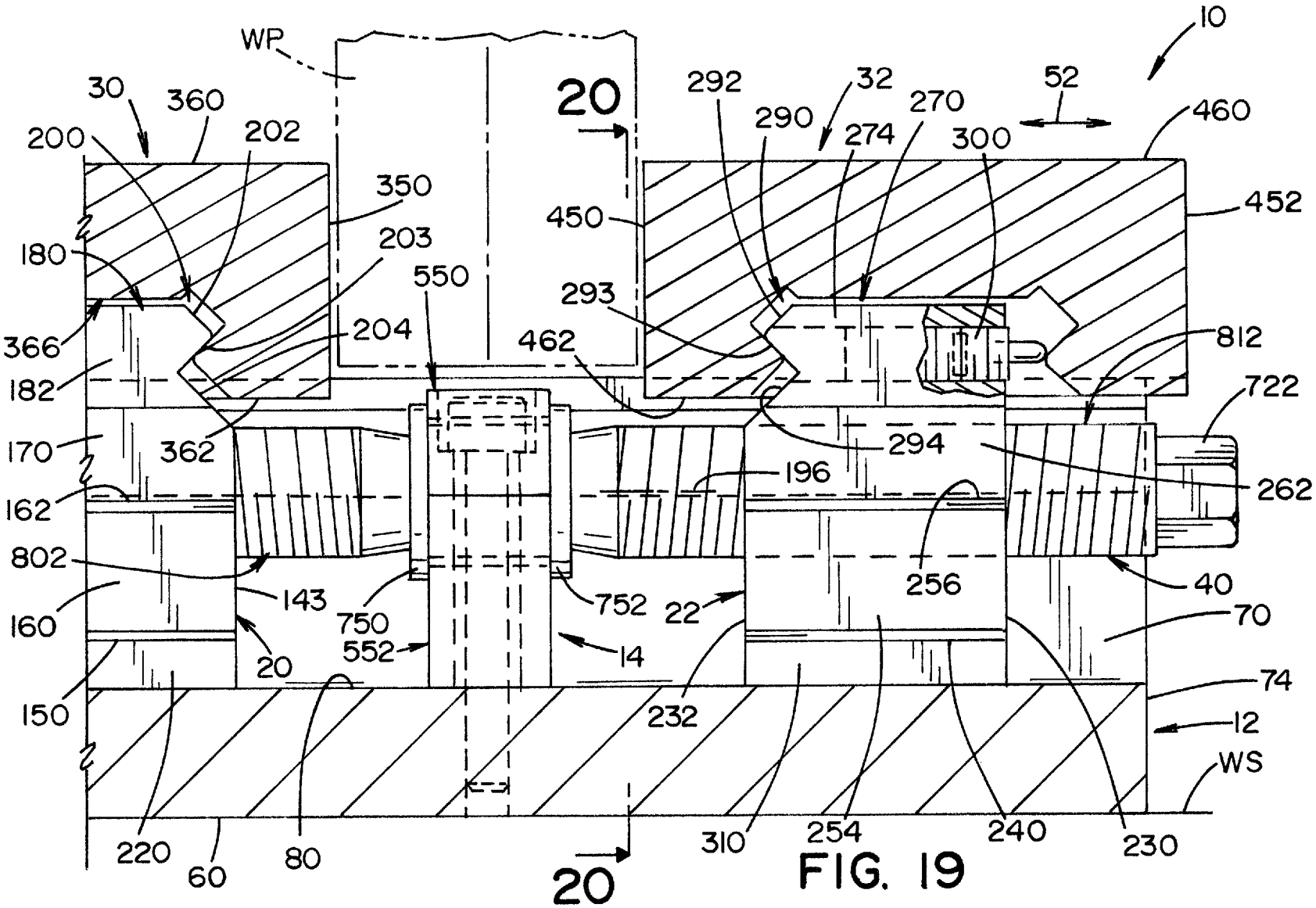
FIG. 19 is a partial sectional view of the vise shown in FIG. 1 showing the jaws, trucks, pillow block and lead screw in a non-engagement position.
Figure 20:
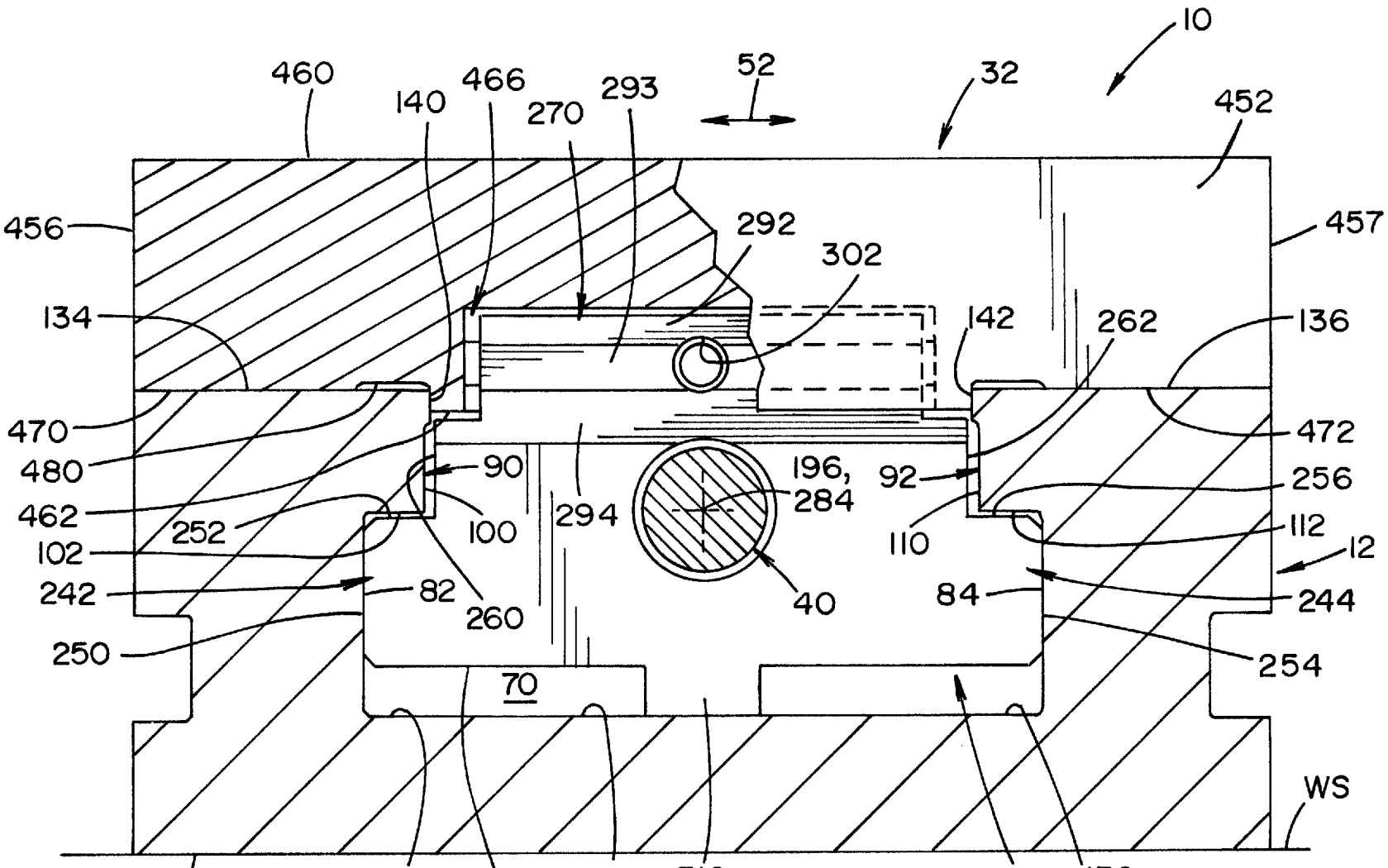
FIG. 20 is a sectional view taken along line 20-20 in FIG. 19.
Figure 21:
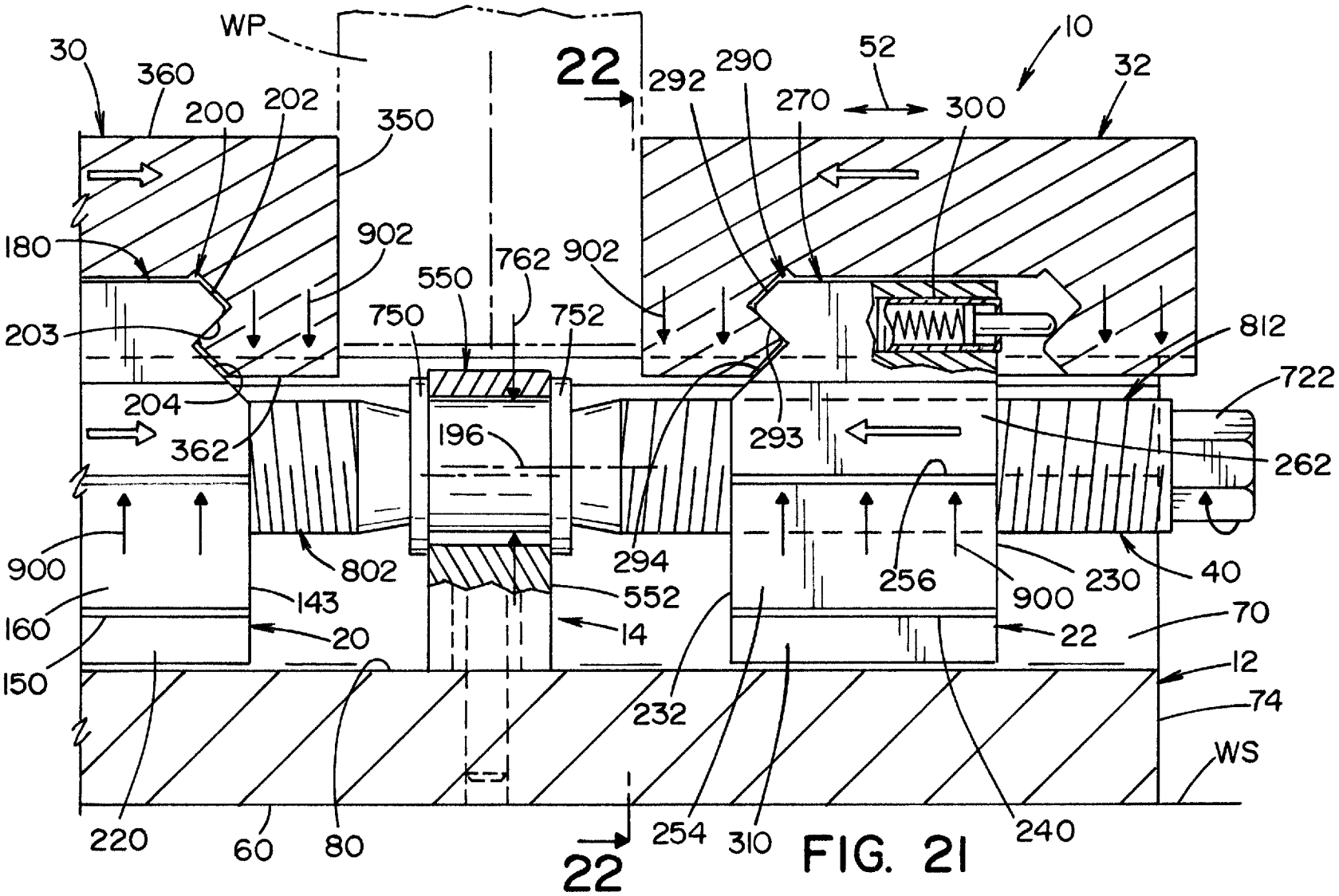
FIG. 21 is a partial sectional view of the vise shown in FIG. 1 showing the jaws, trucks, pillow block and lead screw in an engagement position; and, FIG. 22 is a sectional view taken along line 22-22 in FIG. 20.
Figure 22:
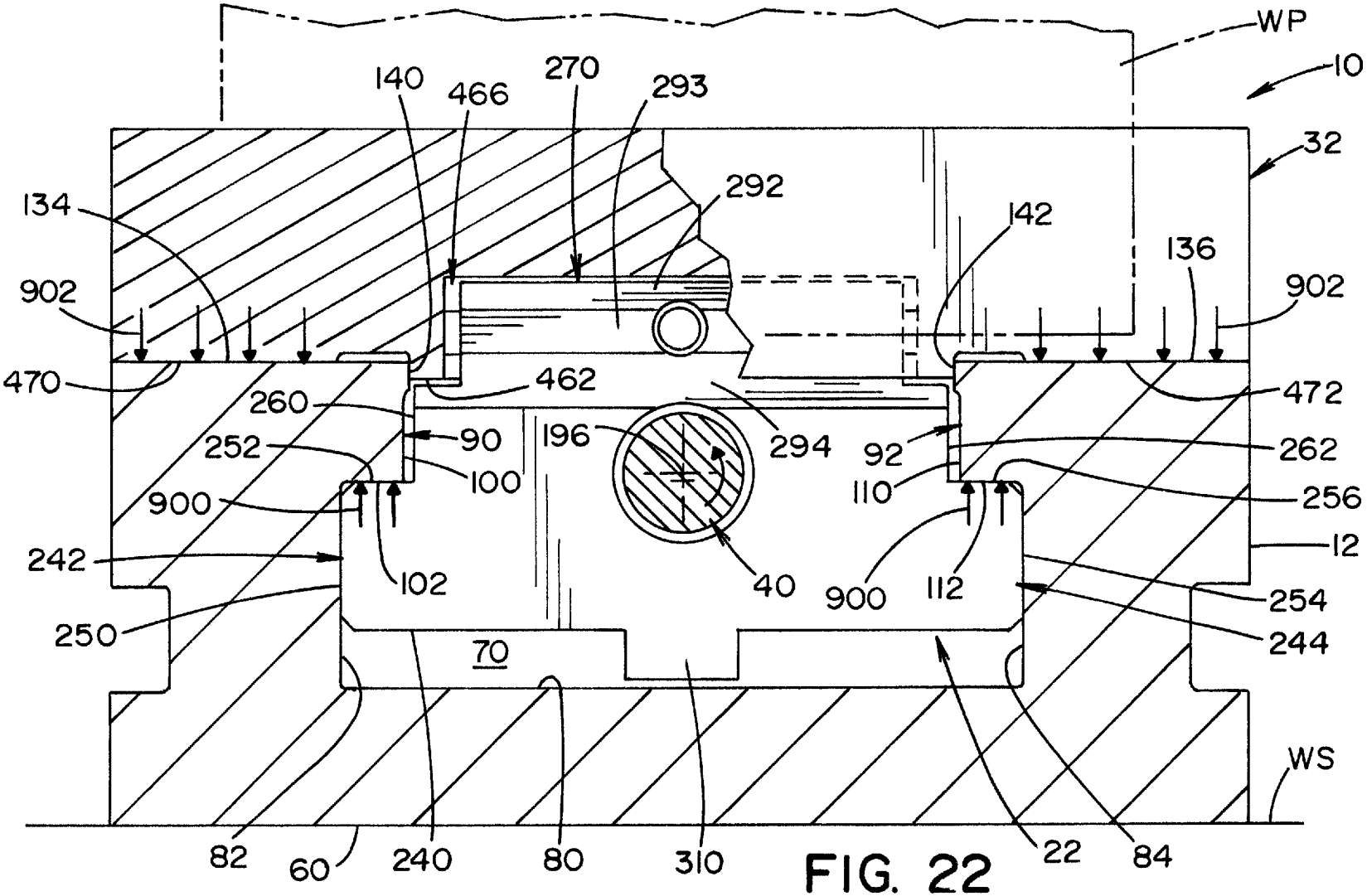

Once vise 10 is in the desired operating position and centered, a workpiece WP can be positioned relative to the vise, which is shown in FIGS. 19 & 20. Once in position, lead screw 40 is rotated (based on the drawings of this application) in first rotational direction 820 to urge the jaws toward one another to "tighten" the jaws on the workpiece toward the position shown in FIGS. 21 & 22. As the jaws engage the work piece, first inwardly extending jaw lift control projection 200 engages first truck pocket 390 of first jaw 30 to create controlled truck lift 900 in first truck 20. Similarly, second inwardly extending jaw lift control projection 290 engages second truck pocket 490 to create controlled truck lift 900 in second truck 22. Continued tightening of the jaws then produces controlled and repeatable truck lift 900 for both trucks as is shown in FIGS. 21 & 22. In this respect, inward movement of the trucks urges the trucks toward one another in guide channel 70 even after jaws 30 and 32 engage the workpiece thereby causing movement of the trucks relative to the jaws in the longitudinal direction. This causes engagement between at least one front surfaces (400, 402, 404) of first truck pocket 390 of the first jaw and at least one control surfaces 202-204 of first inwardly extending jaw lift control projection 200 of the first truck. The angled surfaces cause first truck 20 to lift within guide channel 70 in direction 900 until upper surfaces 162 and 166 of the truck flanges engage downward edges or surfaces 112 and 102 of guide channel 70, respectively. Continued tightening of the trucks will seat upper surfaces 162 and 166 against the downward surfaces 112 and 102 thereby preventing any lift of the first truck during machining of the work piece. Similarly, inward movement of the second jaw causes engagement between at least one front surfaces (400, 402, 404) of second truck pocket 490 of the second jaw and at least one control surfaces 292-294 of second inwardly extending jaw lift control projection 290 of the second truck. The angled surfaces cause second truck 22 to lift within guide channel 70 in direction 900 until upper surfaces 252 and 256 of the truck flanges engage downward edges or surfaces 102 and 112 of guide channel 70, respectively. Continued tightening of the trucks will seat upper surfaces 252 and 256 against the downward surfaces 102 and 112 thereby preventing any lift of second truck during machining of the work piece.

In addition, the jaws can be configured to also take advantage of the lift control projections. In this respect, the engagement of first inwardly extending jaw lift control projection 200 against first truck pocket 390 of first jaw 30 can also create jaw pull down 902 in first jaw 20. Similarly, the engagement of second inwardly extending jaw lift control projection 290 against second truck pocket 490 can create jaw pull down 902 in second jaw 22. Continued tightening of the jaws then produces controlled and repeatable pull down 902 of the jaws. Again, inward movement of the trucks urges the trucks toward one another in guide channel 70 even after jaws 30 and 32 engage the workpiece thereby causing movement of the trucks relative to the jaws in the longitudinal direction. This causes the engagement between at least one front surfaces (400, 402, 404) of first truck pocket 390 of the first jaw and at least one control surfaces 202-204 of first inwardly extending jaw lift control projection 200 of the first truck. The angled surfaces can also cause first jaw 30 to be pulled down toward guide channel 70 until jaw guide surfaces 370 and 372 of first jaw 30 engage first and second base upper guide surfaces 136 and 134, respectively. Continued tightening of the trucks will seat the jaw guide surfaces against the upper guide surfaces of the base. Similarly, inward movement of the second jaw causes engagement between at least one of front surfaces (400, 402, 404) of second truck pocket 490 of the second jaw and at least one of control surfaces 292-294 of second inwardly extending jaw lift control projection 290 of the second truck. The angled surfaces cause second jaw 32 to be pulled down toward guide channel 70 until jaw guide surfaces 470 and 472 of second jaw 32 engage first and second base upper guide surfaces 134 and 136. Continued tightening of the trucks will seat the jaw guide surfaces against the upper guide surfaces of the vise base.

The truck lift and the jaw pull down can also work together to securely pinch the first and second inwardly extending flanges 90 and 92 between the jaws and the trucks. Moreover, the slotted shape of lead screw opening 582 helps facilitate this pinching action between the jaws, the trucks and the guide channel and prevents bending of the lead screw by allowing it to float and allows greater tightening forces to be applied to the workpiece. In this respect, the truck lift produced during jaw tightening produces upward movement of the trucks relative to the base that is transverse to direction 52, which in turn moves first truck screw thread axis 194 of first truck 20 and second truck screw thread axis 284 of second truck away from guide surface 80 of guide channel 70. By having a slotted lead screw opening 582, lead screw 40 can freely move with the trucks thereby reducing bending in the lead screw thereby increasing the pinching effect of the jaws and trucks and increasing the holding force of the vise in view of the reduced friction. Moreover, the pinching effect of the components significantly reduces jaw lift in the vise and does so automatically when the vise is tightened.

Again, rotation of the lead screw in the first rotational direction moves the jaw(s) and the truck(s) from a non-engagement position shown in FIGS. 19 & 20 wherein the jaw clamping surface(s) is spaced from the workpiece, an engaging position wherein the jaw clamping surface(s) is engaging the associated workpiece and a fully engaged position shown in FIGS. 21 & 22 wherein the jaw clamping surface(s) is tightened against the associated workpiece. When in the non-engagement position, the jaw(s) being movable relative to the truck(s) and the vise having a movement clearance between the upper truck surfaces and the base flange bottom surface allowing longitudinal movement of the truck(s) relative to the vise base. When in the engaging position, engagement between the jaw clamping surface(s) of the jaw(s) and the workpiece urging the at least one lifting surface of the jaw(s) against the lift control projection thereby urging the upper truck surface toward the base flange bottom surface(s) and wherein the jaw(s) moves relative to the truck(s) transversely to the longitudinal direction. When in the fully engaged position, the upper truck surface(s) engaging the base flange bottom surface(s) and the jaw(s) being fixed relative to the truck(s).

While not shown, the vise according to the present invention can be used for any known application, and even newly found applications, for these styles of vises. This includes, but is not limited to, powered versions of these vises wherein hand crank 42 is replaced with a powered crank (not shown). Further, the vise according to the present invention could be incorporated as a component of a clamping system without detracting from the invention of this application.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

It is claimed:

1. A vise for holding a workpiece that reduces jaw lift, the vise comprising:

a vise base having a base length extending in a longitudinal direction and a base width transverse to the longitudinal direction, the vise base having a base bottom to support the vise base on an associated underlying surface, the vise base further including a longitudinally extending guide channel that includes a first inwardly extending base flange and a second inwardly extending base flange, the first inwardly extending flange having a first base flange bottom surface and the second inwardly extending base flange having a second base flange bottom surface;

at least one truck that is shaped to be received in the longitudinally extending guide channel for selective longitudinal movement in the longitudinal direction, the at least one truck having a first truck flange and a second truck flange opposite of the first truck flange, the first and second truck flanges being shaped to be received by the longitudinally extending guide channel for the selective longitudinal movement, the first truck flange having a first upper truck surface and the second truck flange having a second upper truck surface wherein the first upper truck surface faces the first base flange bottom surface and the second upper truck surface faces the second base flange bottom surface, the at least one truck further including a threaded truck lead screw opening having a truck lead screw thread, the at least one truck having a jaw mount that includes a truck lift surface;

at least one jaw that is selectively securable relative to the at least one truck, the at least one jaw including a jaw clamping surface extending in the longitudinal direction and configured to engage an associated workpiece, the at least one jaw further including a truck mount that is shaped to receive the jaw mount of the at least one truck, the truck mount having a jaw lift surface;

a lead screw that extends in the longitudinal direction and is selectively rotatable about a lead screw axis, the lead screw having a screw thread coaxial with the lead screw axis and operably connected to the truck lead screw thread wherein rotation of the lead screw in a first rotational direction moves the at least one jaw and the at least one truck toward the associated workpiece and rotation of the lead screw in a second rotational direction moves the at least one jaw and the at least one truck away from the associated workpiece;

wherein rotation of the lead screw in the first rotational direction moves the at least one jaw and the at least one truck from a non-engagement position wherein the jaw clamping surface is spaced from the associated workpiece toward an engaging position wherein the jaw clamping surface engages the associated workpiece and a fully engaged position wherein the jaw clamping surface is tightened against the associated workpiece;

when in the non-engagement position, the at least one jaw being movable relative to the at least one truck transversely to the longitudinal direction and the vise having a movement clearance that is a gap between the first upper truck surface and the first base flange bottom surface allowing the longitudinal movement of the at least one truck relative to the vise base; when in the engaging position, engagement between the jaw clamping surface of the at least one jaw and the associated workpiece urging the jaw lift surface against the truck lift surface thereby urging the first upper truck surface toward the first base flange bottom surface and wherein the at least one truck moves relative to the at least one jaw transversely to the longitudinal direction; when in the fully engaged position, the first upper truck surface engaging the first base flange bottom surface and the at least one jaw being fixed relative to the at least one truck;

wherein the at least one truck includes a first truck and a second truck, the at least one jaw includes a first jaw and a second jaw; the first jaw having a first clamping surface and the second jaw having a second clamping surface; the vise further including a pillow block, the pillow block being securable relative to the vise base between the first and second trucks, the pillow block having a lead screw opening that is shaped to receive the lead screw, the lead screw opening being elongated to allow movement of the lead screw relative to the pillow block that is transverse to the longitudinal direction, wherein when in the engaging position, the engagement between the first and second jaw clamping surfaces of the first and second jaws and the associated workpiece moves the first and second trucks and the lead screw transversely to the longitudinal direction.

2. The vise according to claim 1, wherein when in the non-engagement position, the vise having the movement clearance between the first and second upper truck surfaces and the first and second base flange bottom surfaces respectively allowing the longitudinal movement of the first and second trucks relative to the vise base; when in the engaging position, the engagement between the first and second jaw clamping surfaces of the first and second jaws and the associated workpiece urging the first and second upper truck surfaces toward the first and second base flange bottom surfaces respectively and wherein the first and second trucks move relative to the first and second jaws respectively transversely to the longitudinal direction; when in the fully engaged position, the first and second upper truck surfaces seating against the first and second base flange bottom surfaces respectively and the at least one jaw being fixed relative to the at least one truck.

3. The vise according to claim 1, wherein the first and second trucks include a lift control projection, the truck lift surface being part of the lift control projection.

4. The vise according to claim 3, wherein the truck mount is a pocket in the at least one jaw having the jaw lift surface.

5. The vise according to claim 1, wherein the first and second jaw clamping surfaces face each other.

6. The vise according to claim 1, wherein the first and second jaw clamping surfaces face away from each other.

7. The vise according to claim 1, wherein the lead screw has a lead screw groove including a first groove wall and an opposite second groove wall, the lead screw groove being shaped to lock the lead screw relative to the pillow block longitudinally between the first and second groove walls.

8. The vise according to claim 1, wherein when in the non-engagement position, the vise having the movement clearance between the first and second upper truck surfaces and the first and second base flange bottom surfaces respectively allowing the longitudinal movement of the first and second trucks relative to the vise base; when in the engaging position, the engagement between the jaw clamping surfaces of the first and second jaws and the associated workpiece urging the first and second upper truck surfaces toward the first and second base flange bottom surfaces respectively; and wherein the first and second trucks move relative to the first and second jaws respectively transversely to the longitudinal direction and the lead screw moves relative to the first and second jaws transversely to the longitudinal direction; when in the fully engaged position, the first and second upper truck surfaces engaging the first and second base flange bottom surfaces respectively and the first and second jaws being fixed relative to the at least one truck.

9. The vise according to claim 1, wherein the pillow block is selectively longitudinally adjustable to allow movement of the pillow block in the longitudinal direction.

10. A vise for holding a workpiece that reduces jaw lift, the vise comprising:

a vise base having a base length extending in a longitudinal direction and a base width transverse to the longitudinal direction, the base having a base bottom to support the vise base on an associated underlying surface, the vise base further including a longitudinally extending guide channel that includes a first inwardly extending base flange and a second inwardly extending base flange, the first inwardly extending flange having a first base flange bottom surface and the second inwardly extending base flange having a second base flange bottom surface;

at least one truck that is shaped to be received in the longitudinally extending guide channel for selective longitudinal movement in the longitudinal direction, the at least one truck having a first truck flange and a second truck flange opposite of the first truck flange, the first and second truck flanges being shaped to be received by the longitudinally extending guide channel for the selective longitudinal movement, the first truck flange having a first upper truck surface and the second truck flange having a second upper truck surface wherein the first upper truck surface faces the first base flange bottom surface and the second upper truck surface faces the second base flange bottom surface, the at least one truck further including a threaded truck lead screw opening having a truck lead screw thread, the at least one truck having a jaw mount that includes a truck lift surface;

at least one jaw that is selectively securable relative to the at least one truck, the at least one jaw including a jaw clamping surface extending in the longitudinal direction and configured to engage an associated workpiece, the at least one jaw further including a truck mount that is shaped to receive the jaw mount of the at least one truck, the truck mount having a jaw lift surface;

a lead screw that extends in the longitudinal direction and is selectively rotatable about a lead screw axis, the lead screw having a screw thread coaxial with the lead screw axis and operably connected to the truck lead screw thread wherein rotation of the lead screw in a first rotational direction moves the at least one jaw and the at least one truck toward the associated workpiece and rotation of the lead screw in a second rotational direction moves the at least one jaw and the at least one truck away from the associated workpiece;

wherein rotation of the lead screw in the first rotational direction moves the at least one jaw and the at least one truck from a non-engagement position wherein the jaw clamping surface is spaced from the associated workpiece toward an engaging position wherein the jaw clamping surface engages the associated workpiece and a fully engaged position wherein the jaw clamping surface is tightened against the associated workpiece;

when in the non-engagement position, the at least one jaw being movable relative to the at least one truck and the vise having a movement clearance between the first upper truck surface and the first base flange bottom surface allowing the longitudinal movement of the at least one truck relative to the vise base; when in the engaging position, engagement between the jaw clamping surface of the at least one jaw and the associated workpiece urging the jaw lift surface against the truck lift surface thereby urging the first upper truck surface toward the first base flange bottom surface and wherein the at least one truck moves relative to the at least one jaw transversely to the longitudinal direction; when in the fully engaged position, the first upper truck surface engaging the first base flange bottom surface and the at least one jaw being fixed relative to the at least one truck;

wherein the at least one truck includes a first truck and a second truck, the at least one jaw includes a first jaw and a second jaw; the vise further including a pillow block, the pillow block being securable relative to the vise base between the first and second trucks, the pillow block having a lead screw opening that is shaped to receive the lead screw, the lead screw opening being slotted to allow movement of the lead screw relative to pillow block that is transverse to the longitudinal direction, wherein when in the engaging position, the engagement between the jaw clamping surfaces of the first and second jaws and the associated workpiece moves the first and second trucks and the lead screw transversely to the longitudinal direction, the pillow block is selectively longitudinally adjustable to allow movement of the pillow block in the longitudinal direction; wherein the lead screw includes a lead screw groove having a first groove wall and a second groove wall, the lead screw groove being shaped to lock the lead screw relative to the pillow block longitudinally between the first and second groove walls wherein the longitudinal movement of the pillow block in the longitudinal direction moves the pillow block, the lead screw and the first and second trucks together in the longitudinal direction.

11. The vise according to claim 10, wherein the lead screw groove is a central lead screw groove and the vise is a self-centering vise; the longitudinal movement of the pillow block in the longitudinal direction that moves the pillow block, the lead screw and the first and second trucks together in the longitudinal direction allowing calibration of a center point of the self-centering vise in the longitudinal direction.

12. The vise according to claim 11, further includes center pins selectively securable to the vise base centered at the center point to allow for the calibration of the center point.

13. A vise for holding a workpiece that reduces jaw lift, the vise comprising:

a vise base having a base length extending in a longitudinal direction and a base width transverse to the longitudinal direction, the vise base having a base bottom to support the vise base on an associated underlying surface, the vise base further including a longitudinally extending guide channel that includes a first inwardly extending base flange and a second inwardly extending base flange, the first inwardly extending flange having a first base flange bottom surface and the second inwardly extending base flange having a second base flange bottom surface;

a first truck that is shaped to be received in the longitudinally extending guide channel for selective longitudinal movement in the longitudinal direction, the first truck having oppositely extending first truck flanges with first upper truck surfaces, the first upper truck surfaces facing the first and second base flange bottom surfaces respectively, the first truck further including a first threaded truck lead screw opening having a first truck lead screw thread, the first truck having a first jaw mount that includes a first truck lift surface;

a second truck that is shaped to be received in the longitudinally extending guide channel for selective longitudinal movement in the longitudinal direction, the second truck having oppositely extending second truck flanges with second upper truck surfaces, the second upper truck surfaces facing the first and second base flange bottom surfaces respectively, the second truck further including a second threaded truck lead screw opening having a second truck lead screw thread that is the opposite of the first lead screw thread, the second truck having a second jaw mount that includes a second truck lift surface;

a first jaw that is selectively securable relative to the first truck, the first jaw including a first jaw clamping surface extending in the longitudinal direction and configured to engage an associated workpiece, the first jaw further including a first truck mount that is shaped to receive the first jaw mount of the first truck, the first truck mount having a first jaw lift surface;

a second jaw that is selectively securable relative to the second truck, the second jaw including a second jaw clamping surface extending in the longitudinal direction and configured to engage the associated workpiece, the second jaw further including a second truck mount that is shaped to receive the second jaw mount of the second truck, the second truck mount having a second jaw lift surface;

a lead screw that extends in the longitudinal direction and is selectively rotatable about a lead screw axis, the lead screw having a screw thread coaxial with the lead screw axis and operably connected to the first and second truck lead screw threads wherein rotation of the lead screw in a first rotational direction moves the first and second trucks toward the associated workpiece and rotation of the lead screw in a second rotational direction moves the first and second trucks away from the associated workpiece;

a pillow block, the pillow block being securable relative to the vise base between the first and second trucks, the pillow block having a lead screw opening that is shaped to receive the lead screw, the lead screw opening being elongated to allow movement of the lead screw relative to pillow block that is transverse to the longitudinal direction;

wherein rotation of the lead screw in the first rotational direction moves the first and second jaws and the first and second trucks from a non-engagement position wherein the jaw clamping surfaces are spaced from the associated workpiece toward an engaging position wherein the jaw clamping surfaces engage the associated workpiece and a fully engaged position wherein the jaw clamping surfaces are tightened against the associated workpiece;

when in the non-engagement position, the first and second jaws being movable relative to the first and second trucks respectively transversely to the longitudinal direction and the vise having a movement clearance that is a gap between the first and second upper truck surfaces and the first and second base flange bottom surfaces allowing the longitudinal movement of the first and second trucks relative to the vise base; when in the engaging position, engagement between the jaw clamping surfaces of the first and second jaws and the associated workpiece urging the first and second jaw lift surfaces against the first and second truck lift surfaces thereby urging the first and second upper truck surfaces toward the first and second base flange bottom surfaces and wherein the first and second trucks move relative to the first and second jaws respectively and transversely to the longitudinal direction and the lead screw moving transversely with the first and second trucks in the longitudinal direction relative to the pillow block; when in the fully engaged position, the first and second upper truck surfaces engaging the first and second base flange bottom surfaces respectively and the first jaw being fixed relative to first truck and the second jaw being fixed relative to second truck.

14. A vise for holding a workpiece that reduces jaw lift, the vise comprising a vise base with a guide channel extending in a longitudinal direction, the vise base having a longitudinally extending guide channel with a base surface and inwardly extending base flanges with flange surfaces facing the vise base surfaces, the vise further including opposing trucks and opposing jaws; the opposing trucks being shaped to be received in the guide channel wherein each of the opposing trucks includes truck surfaces facing the flange surfaces and having an operating clearance between the flange surfaces to allow selective longitudinal movement of the opposing trucks in the guide channel, each of the opposing trucks further including a jaw mount to allow one of the opposing vise jaws of the pair of vise jaws to be secured relative thereto and including a truck lift surface; each of the opposing jaws including a jaw clamping surface extending in the longitudinal direction and configured to engage an associated workpiece, each of the opposing jaws further including a jaw lift surface; the vise further including a lead screw extending in the longitudinal direction having lead screw threads operably connected to the opposing trucks wherein rotation in a first direction moves the opposing trucks toward the associated workpiece and rotation in a second direction that is opposite of the first direction moves the opposing trucks away from the associated workpiece; the vise further including pillow block securable relative to the vise base between the opposing trucks and having a lead screw opening that is shaped to receive the lead screw and retain the position of the lead screw relative to the longitudinal direction; the lead screw opening being elongated to allow limited movement of the lead screw relative to the pillow block transversely of the longitudinal direction; engagement between the jaw clamping surfaces and the associated workpiece urging the jaw lift surfaces into the truck lift surfaces and the engagement causing the opposing trucks and the lead screw within the lead screw opening to move transversely in the guide channel wherein the truck surfaces move toward the flange surfaces and reduces the operating clearance.

15. The vise according to claim 14, wherein the opposing trucks each includes a lift control projection, the truck lift surface being part of the lift control projection.

16. The vise according to claim 15, wherein each of the opposing jaws includes a truck mount to secure each jaw relative to each truck, the truck mount including a truck mount pocket having the jaw lift surface.

17. The vise according to claim 14, wherein the pillow block is selectively longitudinally adjustable to allow movement of the pillow block in the longitudinal direction.

18. The vise according to claim 14, wherein the lead screw includes a lead screw groove having a first groove wall and a second groove wall, the lead screw groove being shaped to lock the lead screw relative to the pillow block longitudinally between the first and second groove walls.

19. The vise according to claim 18, wherein the first groove wall and the second groove wall define a groove spacing, the pillow block having a thickness, the groove spacing being larger than the pillow block thickness.

20. A vise for holding a workpiece that reduces jaw lift, the vise comprising a vise base with a guide channel extending in a longitudinal direction, the vise base having a longitudinally extending guide channel with a base surface and inwardly extending base flanges with flange surfaces facing the base surfaces, the vise further including opposing trucks and opposing jaws; the opposing trucks being shaped to be received in the guide channel wherein each of the opposing trucks includes truck surfaces facing the flange surfaces and having an operating clearance between the flange surfaces to allow selective longitudinal movement of the opposing trucks in the guide channel, each of the opposing trucks further including a jaw mount to allow one of the opposing vise jaws of the pair of vise jaws to be secured relative thereto and including a truck lift surface; each of the opposing jaws including a jaw clamping surface extending in the longitudinal direction and configured to engage an associated workpiece, each of the opposing jaws further including a jaw lift surface; the vise further including a lead screw extending in the longitudinal direction having lead screw threads operably connected to the opposing trucks wherein rotation in a first direction moves the opposing trucks toward the associated workpiece and rotation in a second direction that is opposite of the first direction moves the opposing trucks away from the associated workpiece; the vise further including pillow block securable relative to the vise base between the opposing trucks and having a lead screw opening that is shaped to receive the lead screw and retain the position of the lead screw relative to the longitudinal direction; engagement between the jaw clamping surfaces and the associated workpiece urging the jaw lift surfaces into the truck lift surfaces and the engagement causing the opposing trucks to move transversely in the guide channel wherein the truck surfaces move toward the flange surfaces and reduces the operating clearance;

wherein the pillow block is selectively longitudinally adjustable to allow movement of the pillow block in the longitudinal direction; the pillow block is selectively longitudinally adjustable to allow movement of the pillow block in the longitudinal direction; wherein the lead screw includes a lead screw groove having a first groove wall and a second groove wall, the lead screw groove being shaped to lock the lead screw relative to the pillow block longitudinally between the first and second groove walls wherein the longitudinal movement of the pillow block in the longitudinal direction moves the pillow block, the lead screw and the opposing trucks in the longitudinal direction.

21. The vise according to claim 20, wherein the lead screw groove is a central lead screw groove and the vise is a self-centering vise; the longitudinal movement of the pillow block in the longitudinal direction that moves the pillow block, the lead screw and the first and second trucks together in the longitudinal direction allowing calibration of a center point of the self-centering vise in the longitudinal direction.

22. The vise according to claim 21, further includes center pins selectively securable relative to the vise base centered at the center point to allow for the calibration of the center point.

23. A vise for holding a workpiece that reduces jaw lift, the vise comprising a vise base with a guide channel extending in a longitudinal direction, the vise base having a longitudinally extending guide channel with a base surface, the vise base having a first inwardly extending base flange and a second inwardly extending base flange, the first inwardly extending base flange having a first base flange bottom surface and the second inwardly extending base flange having a second base flange bottom surface; the first inwardly extending base flange further including a first base flange top surface and the second inwardly extending base flange further including a second base flange top surface; the vise further including opposing trucks and opposing jaws; the opposing trucks being shaped to be received in the guide channel wherein each of the opposing trucks includes truck surfaces facing the first and second base flange bottom surfaces and having an operating clearance that is a gap between the truck surfaces and the first and second base flange bottom surfaces to allow selective longitudinal movement of the opposing trucks in the guide channel, each of the opposing trucks further including a jaw mount to allow one of the opposing vise jaws to be secured relative thereto respectively and including a truck lift surface; each of the opposing jaws including a jaw clamping surface extending in the longitudinal direction and configured to engage an associated workpiece, each of the opposing jaws further including a jaw lift surface; the vise further including a lead screw extending in the longitudinal direction having lead screw threads operably connected to the opposing trucks wherein rotation in a first direction moves the opposing trucks toward the associated workpiece and rotation in a second direction that is opposite of the first direction moves the opposing trucks away from the associated workpiece; the vise further including pillow block securable relative to the vise base between the opposing trucks and having a lead screw opening that is shaped to receive the lead screw; the lead screw including a lead screw groove having a first groove wall and a second groove wall, the lead screw groove being shaped to lock the lead screw relative to the pillow block longitudinally between the first and second groove walls and to retain the position of the lead screw relative to the longitudinal direction; engagement between the jaw clamping surfaces and the associated workpiece urging the jaw lift surfaces into the truck lift surfaces and the engagement causing the opposing trucks and the opposing jaws to move toward one another respectively and transversely in the guide channel wherein the truck surfaces move toward the first and second base flange bottom surfaces thereby reducing the operating clearance and moving the opposing jaws toward the first and second base flange top surfaces thereby seating the opposing jaws and the opposing trucks onto the first and second inwardly extending base flanges.

* * * * *